US007159522B2

(12) United States Patent
Miyoshi et al.

(10) Patent No.: US 7,159,522 B2
(45) Date of Patent: Jan. 9, 2007

(54) INCOMBUSTIBLE WITHDRAWING SYSTEM

(75) Inventors: Norihisa Miyoshi, Tokyo (JP); Yasuhiro Sawada, Tokyo (JP); Tatsuya Hasegawa, Tokyo (JP); Koh Sasaki, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 11/340,758

(22) Filed: Jan. 27, 2006

(65) Prior Publication Data

US 2006/0137580 A1 Jun. 29, 2006

Related U.S. Application Data

(62) Division of application No. 10/808,414, filed on Mar. 25, 2004, now Pat. No. 7,025,007.

(30) Foreign Application Priority Data

Sep. 26, 2003 (JP) ..... 2003-336513

(51) Int. Cl.
*F23G 5/30* (2006.01)

(52) U.S. Cl. ..... 110/245

(58) Field of Classification Search ..... 110/243–245; 422/139, 145

See application file for complete search history.

(56) References Cited

U.S. PATENT DOCUMENTS

| | | | |
|---|---|---|---|
| 4,535,706 | A | 8/1985 | Klaschka |
| 5,138,982 | A | 8/1992 | Ohshita et al. |
| 5,510,085 | A | 4/1996 | Abdulally |
| 5,570,645 | A | 11/1996 | Garcia-Mallol |
| 5,996,512 | A | 12/1999 | Morin et al. |
| 6,651,805 | B1 | 11/2003 | Yoshikawa |
| 2002/0104739 | A1 | 8/2002 | Yoshikawa |

FOREIGN PATENT DOCUMENTS

| | | |
|---|---|---|
| EP | 1 332 989 | 8/2003 |
| JP | 06257953 A | 9/1994 |
| JP | 10-110924 | 4/1998 |
| JP | 2003-321812 | 11/2002 |
| JP | 2003-54730 | 2/2003 |

*Primary Examiner*—Kenneth Rinehart
(74) *Attorney, Agent, or Firm*—Wenderoth, Lind & Ponack, L.L.P.

(57) ABSTRACT

An incombustible withdrawing system withdraws an incombustible from a fluidized-bed furnace having a fluidized bed formed therein by a fluidized medium. The incombustible withdrawing system has a mixture delivery path to deliver a mixture of the fluidized medium and the incombustible from a bottom of the fluidized-bed furnace. The incombustible withdrawing system also has a fluidized-bed separating chamber disposed downstream of the mixture delivery path to fluidize the mixture by a fluidizing gas and to separate the mixture into a first separated mixture and a second separated mixture. The incombustible withdrawing system includes a return passage to return the first separated mixture to the fluidized-bed furnace, and an incombustible discharge passage to discharge the second separated mixture to an exterior of the fluidized-bed furnace.

6 Claims, 13 Drawing Sheets

378
317
310
317a
360
392
392a
1m
390a
90°
310f
390b
390c
390
331
330a
330
331
310c
310d
391
393
310g
310e
395
302a
316
310b
310
320
316a
378
316
310b
320

INCOMBUSTIBLE WITHDRAWING SYSTEM

This application is a divisional of U.S. application Ser. No. 10/808,414, filed Mar. 25, 2004 now U.S. Pat. No. 7,025,007.

TECHNICAL FIELD

The present invention relates to an incombustible withdrawing system for withdrawing incombustibles from a fluidized-bed combustor, a fluidized-bed gasifier, or a fluidized-bed furnace such as a circulating fluidized-bed boiler, and more particularly to an incombustible withdrawing system for withdrawing incombustibles together with a fluidized medium discharged from a fluidized-bed furnace for combusting, gasifying, or pyrolyzing wastes such as municipal wastes, refuse-derived fuel (RDF), waste plastics, waste fiber-reinforced plastics (waste FRP), biomass wastes, automobile shredder residue (ASR), and waste oil, or solid combustibles such as solid fuel containing incombustibles (e.g. coal). The present invention also relates to a fluidized-bed furnace system having such an incombustible withdrawing system and a fluidized-bed furnace.

BACKGROUND ART

FIG. 1 is a cross-sectional view schematically showing a conventional fluidized-bed gasification system (fluidized-bed furnace system) 501 having an incombustible withdrawing system 502 and a fluidized-bed gasification furnace (fluidized-bed furnace) 505. The incombustible withdrawing system 502 has an incombustible withdrawing chute 504, an incombustible withdrawing conveyor 520, and a double damper 518. Solid combustibles 514 are supplied into the fluidized-bed gasification furnace 505 and partly combusted or gasified in the fluidized-bed gasification furnace 505. Incombustibles are circulated together with a fluidized medium 510 in a fluidized bed 512. The incombustible withdrawing chute 504 has a vertical or inclined surface on which a mixture 510*a* of the incombustibles and the fluidized medium 510 spontaneously flows from a furnace bottom 511. The mixture 510*a* is delivered from the incombustible withdrawing chute 504 through the incombustible withdrawing conveyor 520, which is connected to a lower end of the incombustible withdrawing chute 504, into the double damper 518 disposed downstream of the incombustible withdrawing conveyor 520.

In the fluidized-bed gasification furnace 505, air 524 for partial combustion is supplied from the furnace bottom 511 into the fluidized bed 512 to form a fluidized bed 512 in which a fluidized medium 510 is fluidized and circulated at 350° C. to 850° C. When solid combustibles 514 are supplied into the fluidized bed 512 of the fluidized-bed gasification furnace 505, the solid combustibles 514 are brought into contact with this heated fluidized medium 510 and the air 524 for partial combustion, and immediately pyrolyzed and gasified to produce a gas, tar, and solid carbon.

Pyrolyzed gas produced in the fluidized bed 512 is discharged from a discharge duct 522 provided at an upper portion of the fluidized bed 512. The mixture 510*a* of the fluidized medium 510 and the incombustibles is discharged from the furnace bottom 511 through the incombustible withdrawing chute 504. The discharged fluidized medium 510 contains silica sand, incombustibles such as iron, steel, and aluminum, and unburned char produced in a gasification process.

In the conventional fluidized-bed gasification furnace system 501 described above, it is important to maintain a sealing performance so that a hermetically sealed state can be maintained in a mixture delivery path 516, which extends from the incombustible withdrawing chute 504 to the incombustible withdrawing conveyor 520. Specifically, if a sealing performance is not maintained at a hermetically sealing portion of the mixture delivery path 516, then an unburned combustible gas, carbon monoxide, and the like in the fluidized-bed gasification furnace 505 leak out of the fluidized-bed gasification furnace 505, thereby causing explosion or intoxication to human bodies. When the air 524 for partial combustion leaks into the incombustible withdrawing chute 504, unburned combustibles contained in the fluidized medium 510 are combusted in the incombustible withdrawing chute 504 to increase a temperature of the incombustible withdrawing chute 504. Accordingly, silica sand and ash may be melted to produce clinker. The double damper 218 disposed at an outlet of the incombustible withdrawing conveyor 520 serves to compensate the sealing performance described above.

Even if a hermetically sealed state is maintained in the mixture delivery path 516 extending from the incombustible withdrawing chute 504 to the incombustible withdrawing conveyor 520, unburned char mixed in the fluidized medium 510 to be discharged reacts with dispersed air 524 for partial combustion at a portion above the incombustible withdrawing chute 504, i.e. at a portion 515 near an inlet of the incombustible withdrawing chute 504. Thus, unburned char is combusted so as to increase a temperature of the portion 515, and may produce clinker. Such clinker clogs the incombustible withdrawing chute 504 and hence lowers an availability of the fluidized-bed gasification furnace 505.

SUMMARY OF THE INVENTION

The present invention has been made in view of the above drawbacks. It is, therefore, a first object of the present invention to provide a fluidized-bed furnace system having an incombustible withdrawing system which can withdraw an incombustible to an exterior of the system while a concentration of the incombustible in a mixture of a fluidized medium and the incombustible is increased.

A second object of the present invention is to provide an incombustible withdrawing system which can prevent an unburned gas from leaking out of a fluidized-bed furnace system.

According to a first aspect of the present invention, there is provided an incombustible withdrawing system for withdrawing an incombustible from a fluidized-bed furnace having a fluidized bed formed therein by a fluidized medium. The incombustible withdrawing system has a mixture delivery path to deliver a mixture of the fluidized medium and the incombustible from a bottom of the fluidized-bed furnace. The incombustible withdrawing system also has a fluidized-bed separating chamber disposed downstream of the mixture delivery path to fluidize the mixture by a fluidizing gas and to separate the mixture into a first separated mixture having a high concentration of the fluidized medium, and a second separated mixture having a high concentration of the incombustible. The incombustible withdrawing system includes a return passage to return the first separated mixture to the fluidized-bed furnace, and an incombustible discharge passage to discharge the second separated mixture to an exterior of the fluidized-bed furnace.

Thus, the incombustible withdrawing system has the mixture delivery path, the fluidized-bed separating chamber, the return passage, and the incombustible discharge passage. The fluidized medium is delivered through the mixture delivery path from a bottom of the fluidized-bed furnace and mixed with the incombustible. This mixture of the fluidized medium and the incombustible is fluidized by fluidizing gas in the fluidized-bed separating chamber to vary a concentration distribution of the fluidized medium and the incombustible in the mixture. Thus, the mixture is separated into a first separated mixture having a high concentration of the fluidized medium and a second separated mixture having a high concentration of the incombustible. The first separated mixture can be returned through the return passage to the fluidized-bed furnace. The second separated mixture can be discharged through the incombustible discharge passage to the exterior of the fluidized-bed furnace.

According to a preferred aspect of the present invention, the incombustible discharge passage is disposed downstream of the fluidized-bed separating chamber. The incombustible discharge passage may deliver the second separated mixture upwardly and discharge the second separated mixture, from a position located higher than a surface of the fluidized bed, to the exterior of the fluidized-bed furnace. With such an incombustible discharge passage, the second separated mixture can be delivered upwardly and discharged from a position located higher than the surface of the fluidized bed to the exterior of the fluidized-bed furnace.

According to a preferred aspect of the present invention, the incombustible withdrawing system further includes a fluidized medium delivering device to deliver the second separated mixture in a vertical direction in the incombustible discharge passage. Alternatively, the incombustible withdrawing system may further include a fluidized medium delivering device to deliver the second separated mixture in the incombustible discharge passage with at least an angle of repose of the fluidized medium with respect to a horizontal plane. With such a fluidized medium delivering device, the second separated mixture can be delivered upwardly in the incombustible discharge passage in a vertical direction or with at least an angle of repose of the fluidized medium with respect to a horizontal plane.

According to a preferred aspect of the present invention, the fluidized-bed separating chamber comprises a passage portion connected to the incombustible discharge passage. The passage portion has cross-sectional areas gradually increased toward the incombustible discharge passage, and a bottom surface inclined downwardly to the incombustible discharge passage. With this arrangement, the mixture can effectively be separated into the first separated mixture and the second separated mixture in the passage portion.

According to a second aspect of the present invention, there is provided an incombustible withdrawing system for withdrawing an incombustible from a fluidized-bed furnace having a fluidized bed formed therein by a fluidized medium. The incombustible withdrawing system has a mixture delivery path to deliver a mixture of the fluidized medium and the incombustible from a bottom of the fluidized-bed furnace. The incombustible withdrawing system also has an incombustible discharge passage disposed downstream of the mixture delivery path to deliver the mixture vertically upward and to discharge the mixture from a position, located higher than a surface of the fluidized bed, to an exterior of the fluidized-bed furnace.

Thus, the incombustible withdrawing system has the mixture delivery path and the incombustible discharge passage. The mixture delivered through the mixture delivery path from the bottom of the fluidized-bed furnace can be delivered vertically upward and discharged from a position located higher than the surface of the fluidized bed to the exterior of the fluidized-bed furnace by the incombustible discharge passage.

According to a third aspect of the present invention, there is provided an incombustible withdrawing system for withdrawing an incombustible from a fluidized-bed furnace having a fluidized bed formed therein by a fluidized medium. The incombustible withdrawing system has a mixture delivery path to deliver a mixture of the fluidized medium and the incombustible from a bottom of the fluidized-bed furnace. The incombustible withdrawing system also has an incombustible discharge passage disposed downstream of the mixture delivery path and a fluidized medium delivering device to deliver the mixture vertically upward in the incombustible discharge passage to an exterior of the fluidized-bed furnace. The incombustible withdrawing system includes a projection projecting radially inwardly from an inner surface of the incombustible discharge passage. With such an arrangement, the mixture is prevented from being rotated in a circumferential direction together with a rotating screw vane, and thus stable delivery can be achieved.

According to a fourth aspect of the present invention, there is provided an incombustible withdrawing system for withdrawing an incombustible from a fluidized-bed furnace having a fluidized bed formed therein by a fluidized medium. The incombustible withdrawing system has a mixture delivery path to deliver a mixture of the fluidized medium and the incombustible from a bottom of the fluidized-bed furnace. The incombustible withdrawing system also has an incombustible discharge passage disposed downstream of the mixture delivery path, and a screw conveyor having a screw vane to deliver the mixture vertically upward in the incombustible discharge passage to an exterior of the fluidized-bed furnace. The screw conveyor has a blocking member provided on a rear face of the screw vane.

According to a fifth aspect of the present invention, there is provided an incombustible withdrawing system for withdrawing an incombustible from a fluidized-bed furnace having a fluidized bed formed therein by a fluidized medium. The incombustible withdrawing system has a mixture delivery path to deliver a mixture of the fluidized medium and the incombustible from a bottom of the fluidized-bed furnace. The incombustible withdrawing system also has an incombustible discharge passage disposed downstream of the mixture delivery path, and a fluidized medium delivering device to deliver the mixture vertically upward in the incombustible discharge passage to an exterior of the fluidized-bed furnace. The incombustible withdrawing system includes a blowing device to blow a gas into a lower portion of the fluidized medium delivering device to increase pressure of the lower portion of the fluidized medium delivering device.

According to a sixth aspect of the present invention, there is provided a fluidized-bed furnace system having a fluidized-bed furnace having a fluidized bed formed therein by a fluidized medium to combust, gasify, or pyrolyze an object containing an incombustible. The fluidized-bed furnace system has the aforementioned incombustible withdrawing system. With this arrangement, the first separated mixture can be returned to the fluidized-bed furnace, and the second separated mixture can be discharged to the exterior of the fluidized-bed furnace.

The above and other objects, features, and advantages of the present invention will be apparent from the following description when taken in conjunction with the accompanying drawings which illustrate preferred embodiments of the present invention by way of example.

DETAILED DESCRIPTION OF THE PREFERRED EMBODIMENTS

An incombustible withdrawing system according to embodiments of the present invention will be described below with reference to FIGS. 2 through 13.

Figure 1:
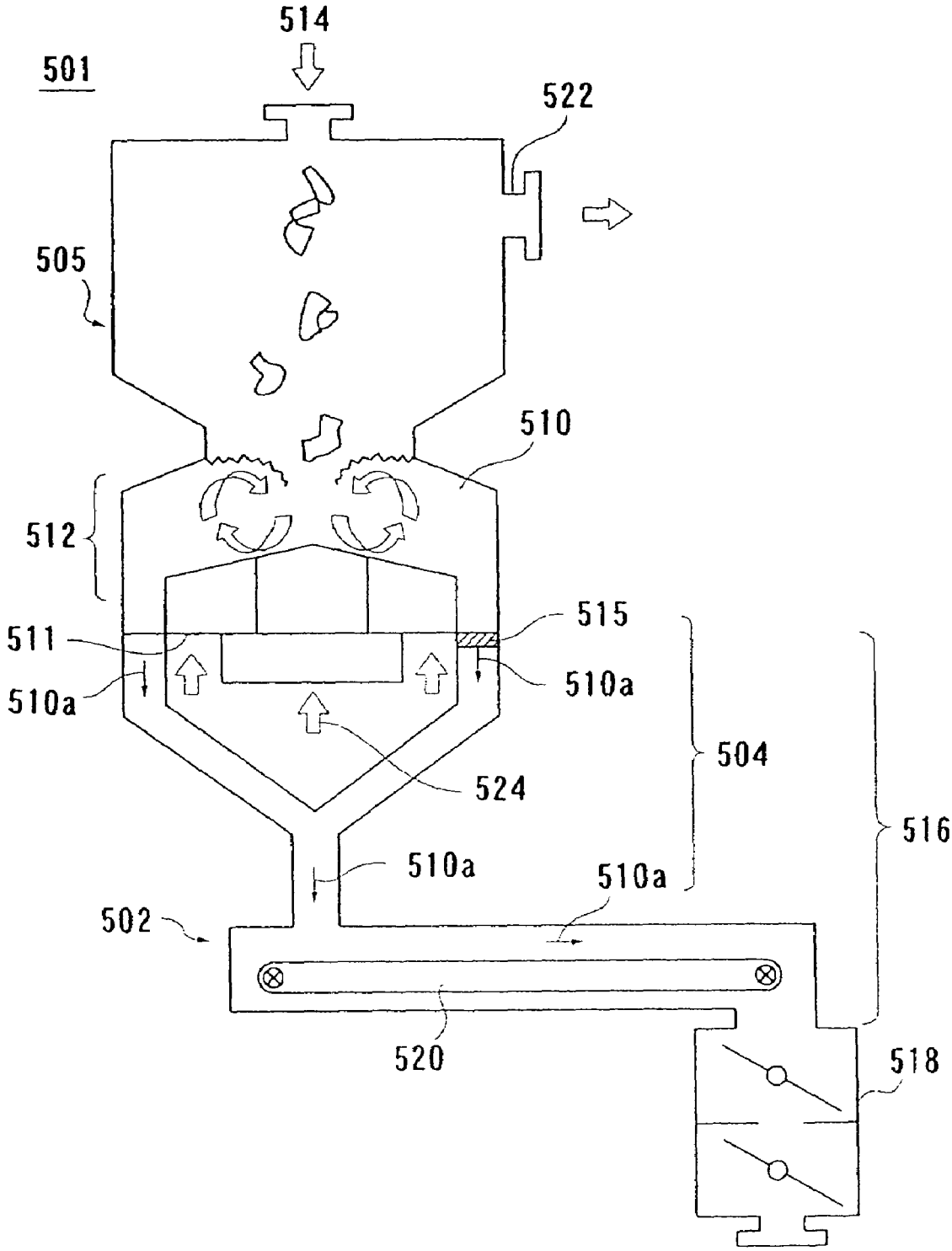
FIG. 1 PRIOR ART
FIG. 1 is a cross-sectional view schematically showing a conventional fluidized-bed gasification furnace system.
Figure 2:
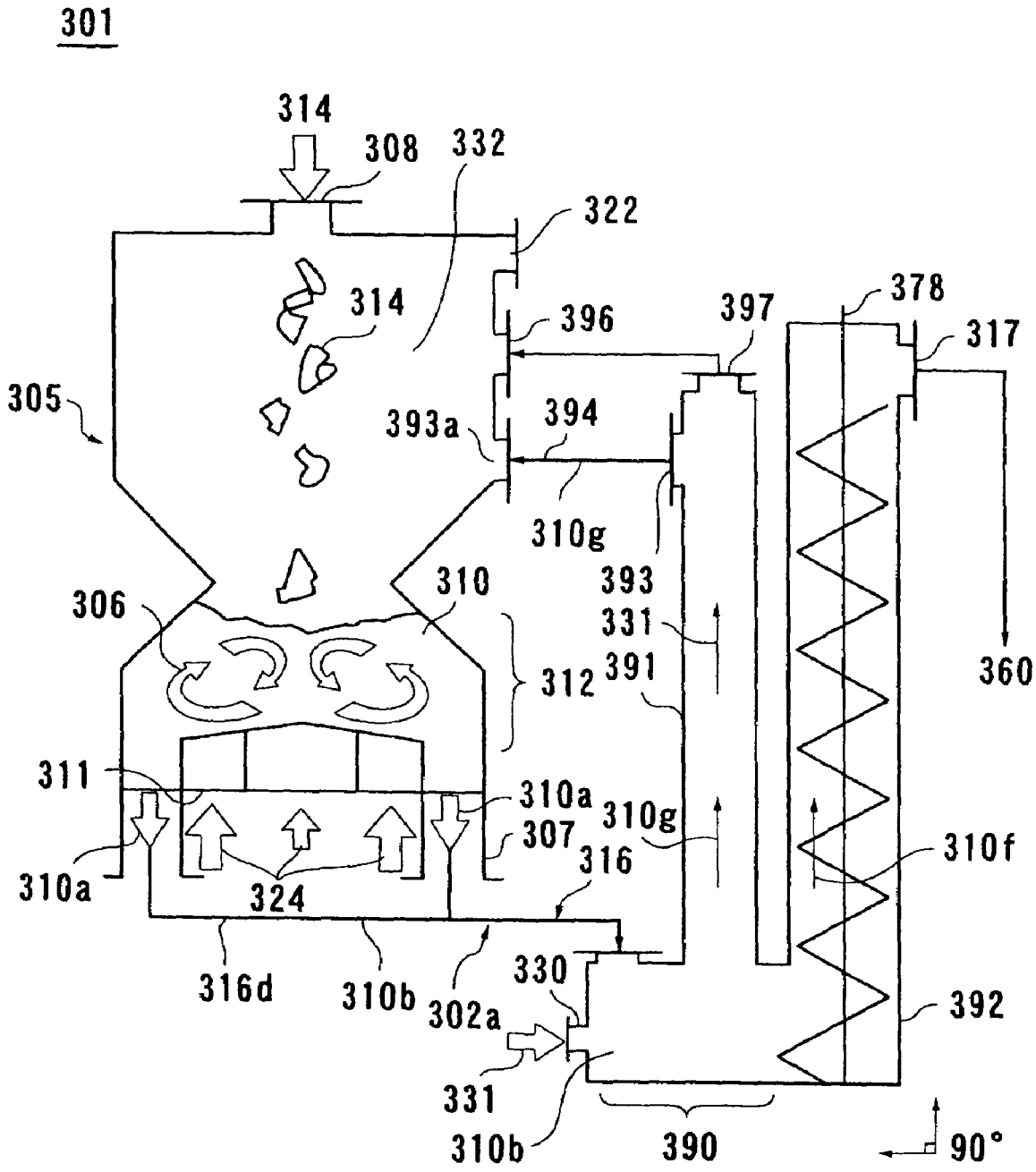
FIG. 2 is a schematic diagram showing an incombustible withdrawing system in a gasification system according to a first embodiment of the present invention.

FIG. 2 is a schematic diagram showing an incombustible withdrawing system in a gasification system (fluidized-bed furnace system) 301 according to a first embodiment of the present invention. The fluidized-bed furnace system 301 has a fluidized-bed furnace 305 holding a fluidized medium 310 therein and an incombustible withdrawing system 302*a*. The fluidized-bed furnace 305 comprises a cylindrical or rectangular receptacle provided vertically on the ground. The incombustible withdrawing system 302*a* has a mixture delivery path 316 provided below the fluidized-bed furnace 305, a fluidized-bed separating chamber 390 located downstream of the mixture delivery path 316, a fluidized medium ascent chamber 391 provided as a return passage above the fluidized-bed separating chamber 390, a rising chamber 392 provided as an incombustible discharge passage downstream of the fluidized-bed separating chamber 390, and a fluidized medium return passage 394 provided downstream of the fluidized medium ascent chamber 391. The mixture delivery path 316 has an incombustible withdrawing chute 307 and a horizontal mixture delivery path 316*d*. The incombustible withdrawing chute 307 is connected to a bottom 311 of the fluidized-bed furnace 305 and arranged in a vertical direction. The horizontal mixture delivery path 316*d* is connected to the incombustible withdrawing chute 307 and arranged in a horizontal direction.

Combustible wastes 314 are introduced into the fluidized-bed furnace 305 through a supply port 308 provided at an upper wall of the fluidized-bed furnace 305. A high-temperature fluidized medium 310 having a combustion temperature for combusting the combustible wastes 314 is fluidized by air 324 for combustion which is blown from furnace bottom 311 to thereby form circulating fluidization 306. Thus, a dense circulating fluidized bed 312 is formed in the fluidized-bed furnace 305. The combustible wastes 314 are combusted in the circulating fluidized bed 312. For example, the combustible wastes 314 comprise wastes such as municipal wastes, refuse-derived fuel (RDF), waste plastics, waste fiber-reinforced plastics (waste FRP), biomass wastes, automobile shredder residue (ASR), waste oil, or combustibles such as solid fuel containing incombustibles (e.g. coal).

The combustible wastes 314 supplied into the fluidized-bed furnace 305 are completely combusted in the fluidized-bed furnace 305. The combustible wastes 314 which have been completely combusted form a mixture 310*a* of the fluidized medium 310 and incombustibles. The mixture 310*a* is withdrawn from the bottom 311 of the fluidized-bed furnace 305 through the mixture delivery path 316 into the fluidized-bed separating chamber 390. A gas produced by complete combustion of the combustible wastes 314 is discharged through a discharge duct 322 provided at an upper portion of the fluidized-bed furnace 305 and, for example, supplied to a subsequent slagging combustion furnace system.

The mixture 310*a* flows down from the bottom 311 of the fluidized-bed furnace 305 to the horizontal mixture delivery path 316*d* of the mixture delivery path 316. Then, a mixture 310*b* in the horizontal mixture delivery path 316*d* is delivered through the mixture delivery path 316 to the fluidized-bed separating chamber 390 in a hermetically sealed manner by a screw conveyor (not shown) disposed in the horizontal mixture delivery path 316*d*.

A mixture 310*b* supplied into the fluidized-bed separating chamber 390 is separated into a first separated mixture 310*g* having a high concentration of the fluidized medium 310, and a second separated mixture 310*f* having a high concentration of the incombustibles, by a fluidizing gas 331 (e.g. an inert gas containing no oxygen) supplied through a supply port 330. The first mixture 310*g* ascends through the fluidized medium ascent chamber 391 together with the fluidizing gas 331 and is delivered from a fluidized medium discharge port 393 through the fluidized medium return passage 394 to a return port 393*a* of the fluidized-bed furnace 305. Thus, the first mixture 310*g* is supplied to a freeboard 332 of the fluidized-bed furnace 305. The fluidizing gas 331 to be supplied into the fluidized-bed separating chamber 390 may comprise a gas containing oxygen such as air if the first mixture 310*g* has a sufficiently low concentration of unburned combustibles.

Further, gas is discharged from the fluidized medium ascent chamber 391 through a fluidizing gas discharge port 397 provided at a top of the fluidized medium ascent chamber 391, and supplied through a pipe from a gas return port 396 of the fluidized-bed furnace 305 to the freeboard 332 of the fluidized-bed furnace 305. The gas from the fluidized medium ascent chamber 391 is effectively utilized as a secondary combustion gas in the fluidized-bed furnace 305. The discharge port 397 and the fluidized medium discharge port 393 may be integrated with each other. In this case, the gas return port 396 and the return port 393*a* can also be integrated with each other.

Thus, the fluidized medium ascent chamber 391 is communicated with the freeboard 332 of the fluidized-bed furnace 305. Therefore, an extremely large pressure difference can be prevented from being produced between the fluidized-bed furnace 305 and the fluidized medium ascent chamber 391.

The second mixture 310*f* flows into the rising chamber 392 as an incombustible discharge passage disposed adjacent to the fluidized-bed separating chamber 390. The second mixture 310*f* is moved vertically upward within the rising chamber 392 by a vertically delivering screw conveyor 378 as a fluidized medium delivering device, and discharged as incombustibles 360 through an incombustible discharge port 317 to an exterior of the rising chamber 392 or to a subsequent slagging combustion furnace system (not shown). In the illustrated example, the rising chamber 392 is provided vertically with an angle of 90° with respect to the ground.

As described above, the incombustibles are withdrawn in a downward direction and then in an upward direction. Thus, the incombustible withdrawing system according to the present invention is different from a conventional incombustible withdrawing system which withdraws incombustibles only in a downward direction. Gas or combustion air 324 in the fluidized-bed furnace 305 can reliably be prevented from leaking into the incombustible withdrawing chute 307 without a mechanical sealing device such as a double damper.

Further, with the conventional incombustible withdrawing system, a ratio of withdrawn incombustibles to the second mixture 310*f* containing the fluidized medium 310 is several percent to about ten percent. With the incombustible withdrawing system 302*a* according to the present invention, a ratio of withdrawn incombustibles to the second mixture 310*f* containing the fluidized medium 310 can remarkably be increased to 30% to 50%. Even if automobile shredder residue containing incombustibles of above 20% is supplied to the fluidized-bed furnace 305, and a large amount of incombustibles is withdrawn together with the fluidized medium 310 to an exterior of the system, a ratio of incombustibles contained in the second mixture 310*f* can be increased.

Figure 2A:
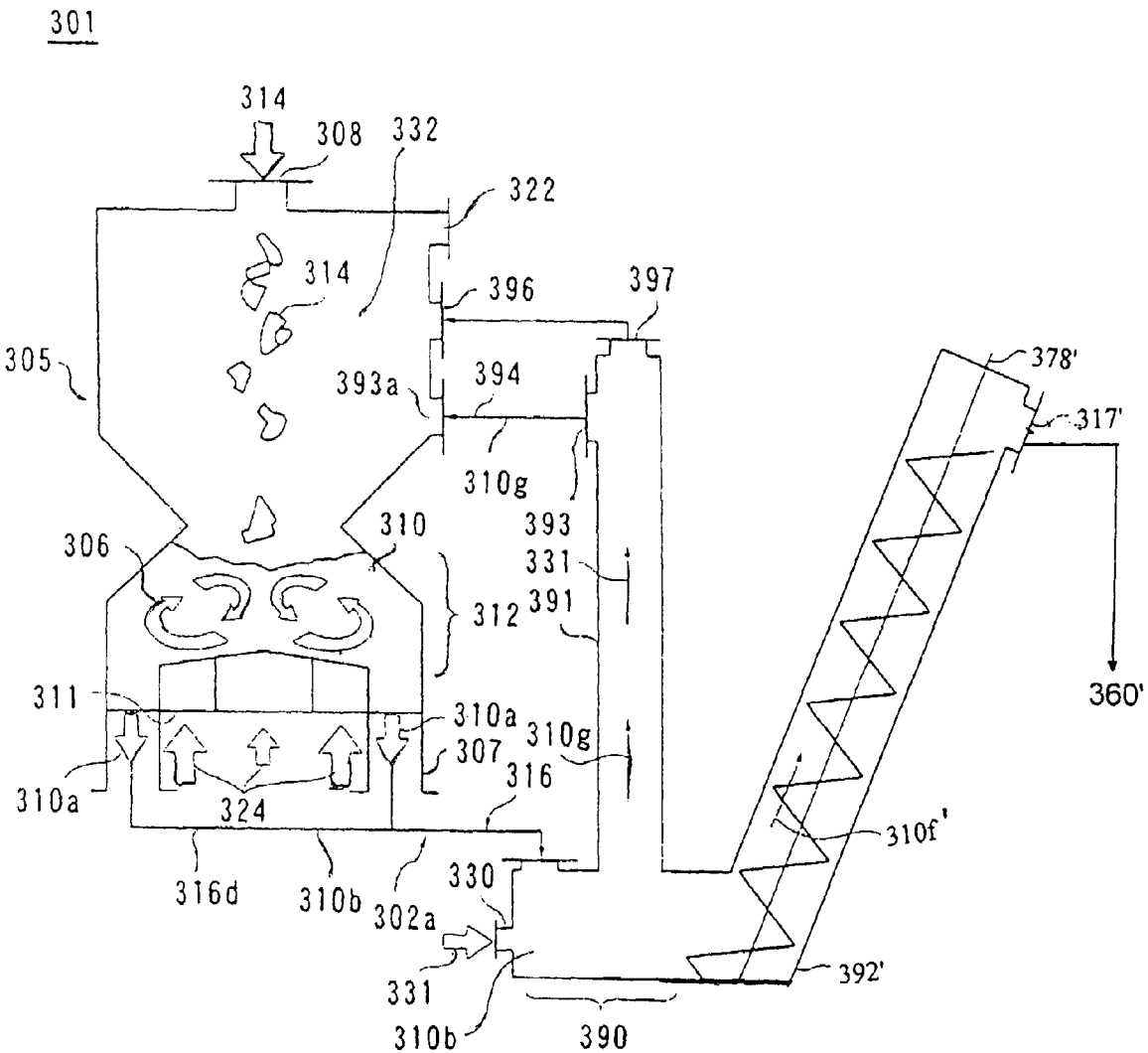
FIG. 2A is a schematic diagram showing a modification of the incombustible withdrawing system of FIG. 2.

FIG. 2A shows a modification of the incombustible withdrawing system of FIG. 2, wherein rising chamber 392' extends non-vertically. With this arrangement, second mixture 310*f* is moved non-vertically within the rising chamber 392' by non-vertically delivering screw conveyor 378', and discharged as incombustibles 360' through incombustible discharge port 317'.

For example, in order to prevent clinker from being produced, a cooling system (not shown) may be added to cool the fluidized medium 310*a* flowing through the incombustible withdrawing chute 307. In such a case, it is possible to prevent a heat recovery ratio from being lowered by heat loss and to prevent troubles accordingly caused by a high-temperature fluidized medium downstream of the incombustible withdrawing chute 307. Thus, various adverse influences such as increased consumption of auxiliary fuel can effectively be prevented. Further, a large amount of fluidized medium 310 can completely be cooled to a level such that the fluidized medium 310 causes no problems downstream of the incombustible withdrawing chute 307.

FIG. 2A shows a modification of the incombustible withdrawing system of FIG. 2, wherein rising chamber 392' extends non-vertically. With this arrangement, second mixture 310*f* is moved non-vertically within the rising chamber 392' by non-vertically delivering screw conveyor 378', and discharged as incombustibles 360' through incombustible discharge port 317'.

Figures 3A, 3B:
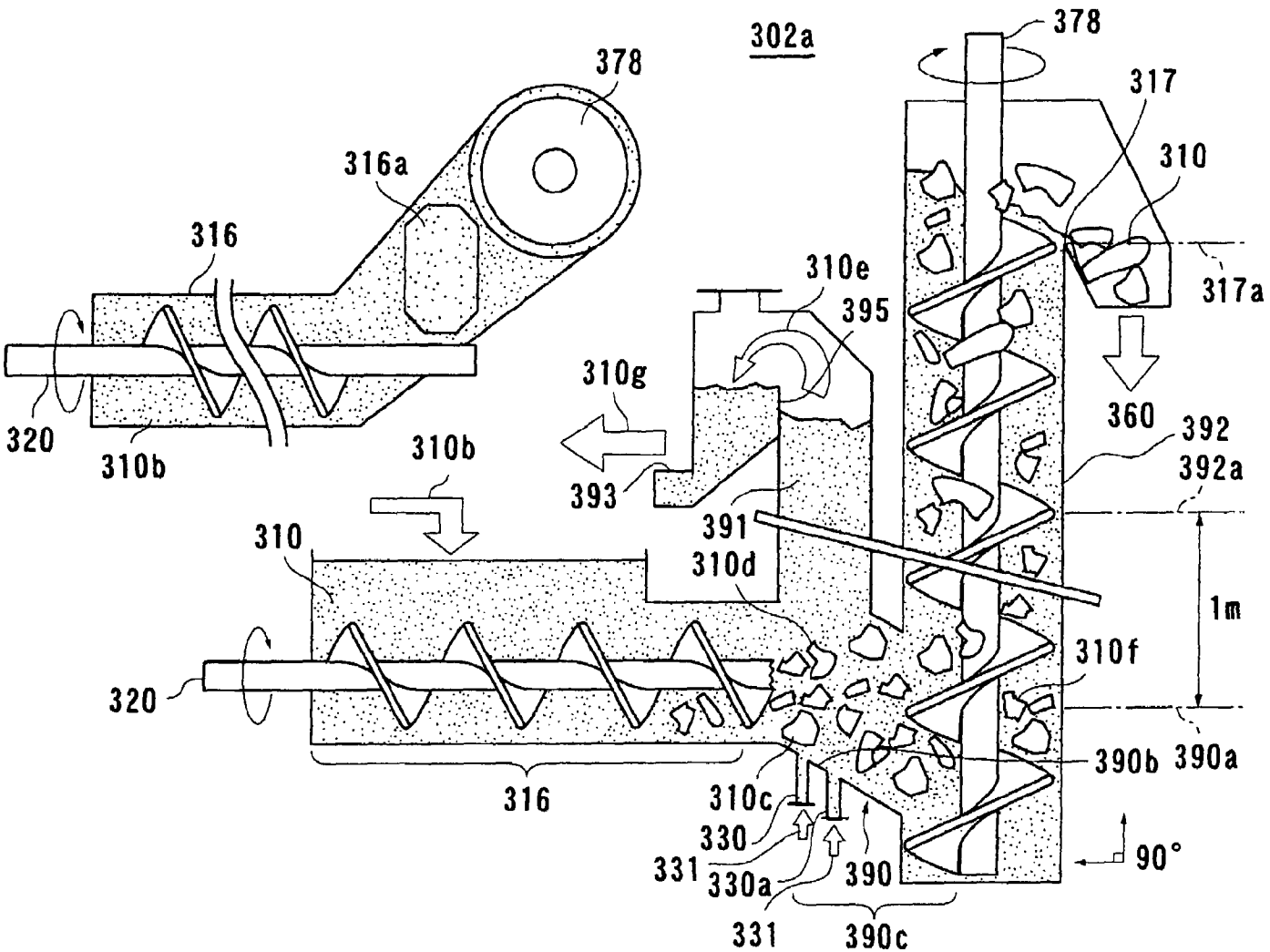
FIGS. 3A and 3B are schematic diagrams showing an incombustible withdrawing system in a gasification system according to a second embodiment of the present invention.

FIGS. 3A and 3B are schematic diagrams showing an incombustible withdrawing system 302*a* in a gasification system according to a second embodiment of the present invention. FIG. 3A is a horizontal cross-sectional view, and FIG. 3B is a vertical cross-sectional view. The incombustible withdrawing system 302*a* has a mixture delivery path 316, a mixture discharge port 316*a*, a fluidized-bed separating chamber 390 provided downstream of the mixture discharge port 316*a*, a fluidized medium ascent chamber 391 provided as a return passage above the fluidized-bed separating chamber 390, and a rising chamber 392 provided as an incombustible discharge passage downstream of the fluidized-bed separating chamber 390.

A mixture 310*b* of a fluidized medium 310 having a particle diameter of, for example, about several tens of micrometers to several millimeters, and incombustibles having a minor axis of, for example, several millimeters to about 200 mm, is withdrawn from a bottom of a fluidized-bed furnace (not shown). The mixture 310*b* is delivered through the mixture discharge port 316*a* to the fluidized-bed separating chamber 390 by a screw conveyor 320, which is rotatably supported in the mixture delivery path 316.

The mixture 310*b* supplied into the fluidized-bed separating chamber 390 is fluidized as powdery particles in the fluidized-bed separating chamber 390 to form a fluidized bed. A concentration distribution of the fluidized medium 310 and incombustibles in the mixture 310*b* is varied so that concentration of the fluidized medium 310 is high at an upper portion of the fluidized bed, and that concentration of incombustibles is high at a lower portion of the fluidized bed. Thus, the mixture 310*b* is separated into a first separated mixture 310*g* having a high concentration of the fluidized medium, and a second separated mixture 310*f* having a high concentration of the incombustibles.

The first mixture 310*g* having a high concentration of the fluidized medium 310 is returned through the fluidized medium ascent chamber 391 to the fluidized-bed furnace (not shown). The second mixture 310 *f* having a high concentration of the incombustibles is discharged through the rising chamber 392 to an exterior of the fluidized-bed furnace (not shown).

The fluidized-bed separating chamber 390 of the incombustible withdrawing system 302*a* has a passage portion 390*c* connected to the rising chamber 392. The passage portion 390*c* has a bottom surface 390*b* inclined downward to the rising chamber 392. Supply ports 330 and 330*a* are provided as fluidizing gas dispersion nozzles on the bottom surface 390*b* of the passage portion 390*c* so that the supply port 330 is located at a position higher than the supply port 330*a*. Steam, which is a gas containing no oxygen, is blown as a fluidizing gas 331 into the fluidized-bed separating chamber 390. The fluidizing gas 331 may comprise carbon dioxide, which is a gas containing no oxygen.

Thus, a gas containing no oxygen is used as the fluidizing gas 331 in order to forestall problems that the fluidizing gas 331 flows back to the fluidized-bed furnace (not shown) so as to produce clinker. Therefore, the fluidizing gas 331 supplied into the fluidized-bed separating chamber 390 may comprise a gas containing oxygen such as air if the fluidized medium has a sufficiently low concentration of unburned combustibles.

In order to prevent the fluidized medium from being locked in the fluidized-bed separating chamber 390, steam as the fluidizing gas 331 is supplied through the supply ports 330 and 330*a* into the fluidized-bed separating chamber 390 by a blowing device such as a blower (not shown) so that the fluidized medium maintains at least a minimum fluidization velocity thereof. In order to separate fluidized medium 310*d* and incombustibles 310*c* in the fluidized-bed separating chamber 390 more effectively, it is desirable to supply the fluidizing gas 331 so that the fluidized medium maintains at least a minimum fluidization velocity. This fluidization of the fluidized medium moves the incombustibles 310*c* toward the bottom surface 390*b* of the fluidized-bed separating chamber 390 and gently moves the fluidized medium 310*d* to an upper portion of the fluidized-bed separating chamber 390 to thereby separate the fluidized medium 310*d* and the incombustibles 310*c*.

Specifically, a concentration of the incombustibles in the mixture 310*b* (mixture of the fluidized medium 310*d* and the incombustibles 310*c*) becomes relatively high near the bottom surface 390*b* of the passage portion 390*c* in the fluidized-bed separating chamber 390 so as to concentrate the incombustibles 310*c*. Further, since the incombustibles 310*c* are brought into direct contact with the fluidizing gas 331 blown from the supply ports 330 and 330*a*, the incombustibles 310*c* are rapidly cooled. Incombustibles 310*c* fluidized near the bottom surface 390*b* of the passage portion 390*c*, which are first brought into contact with the fluidizing gas 331, are cooled more than any other incombustible in the fluidized-bed separating chamber 390.

The first mixture 310*g* containing the fluidized medium 310*d* is collected to an upper portion of the fluidized-bed separating chamber 390, and ascends through the fluidized medium ascent chamber 391 provided above the fluidized-bed separating chamber 390 together with an upward flow of the fluidizing gas 331 blown from the supply ports 330 and 330*a*. The fluidized medium ascent chamber 391 has a fluidized medium discharge port 393 at an upper portion thereof. The first mixture 310*g* containing the fluidized medium 310*e* is then discharged from the fluidized medium discharge port 393 through a return port (not shown) to the fluidized-bed furnace (not shown).

The fluidized medium ascent chamber 391 has a weir 395 located upstream of the fluidized medium discharge port 393 so that only a fluidized medium ejected above a predetermined height can be discharged from the fluidized medium discharge port 393. The weir 395 serves to fill the fluidized medium discharge port 393 with the first mixture 310*g* containing the fluidized medium 310*e* and to balance pressures between the fluidized medium discharge port 393 and the fluidized-bed furnace (not shown) to which the first mixture 310*g* is discharged. The weir 395 is effective in controlling a pressure of the fluidized medium ascent chamber 391 independently of a pressure of the fluidized-bed furnace (not shown).

On the other hand, the incombustibles 310*c* near the bottom surface 390*b* of the passage portion 390*c* are supplied into the rising chamber 392 along the bottom surface 390*b* of the passage portion 390*c* as a second mixture 310*f* containing a concentrated fluidized medium 310 and the incombustibles 310*c*. As shown in FIG. 3B, the passage portion 390*c* has cross-sectional areas gradually increased toward a bottom of the rising chamber 392.

Specifically, even if a fluidized medium in the mixture 310*b* which has an increased concentration of incombustibles causes bridge troubles, the mixture 310*b* can be introduced smoothly from the fluidized-bed separating chamber 390 into the rising chamber 392. Further, a height difference and a cross-sectional difference in the passage portion 390*c* can effectively prevent the second mixture 310*f* from flowing back from the rising chamber 392 to the fluidized-bed separating chamber 390.

The rising chamber 392 has a screw conveyor 378 as a fluidized medium delivering device for moving the second mixture 310*f* vertically upward. In order to move the second mixture 310*f* in a state such that the rising chamber 392 is filled with the second mixture 310*f*, the fluidized medium delivering device should preferably have a delivery efficiency less than 100%.

Specifically, if the rising chamber 392 is not completely filled with the second mixture 310*f* containing the fluidized medium, sealing performance to an external pressure is lowered. In such a case, the fluidizing gas 331 supplied from the supply port 330 into the fluidized-bed separating chamber 390 may flow into the rising chamber 392, thereby preventing separation in the fluidized-bed separating chamber 390. Further, it is accordingly difficult to hold a pressure of the fluidized-bed separating chamber 390. Thus, a gas in the fluidized-bed furnace (not shown) may flow into the fluidized-bed separating chamber 390 and the rising chamber 392, and finally leak out of the rising chamber 392. Therefore, the fluidized medium delivering device should preferably have a delivery efficiency less than 100%.

The rising chamber 392 has an incombustible discharge port 317 located at an upper portion of the rising chamber 392. A lowermost position 317*a* of the incombustible discharge port 317 can arbitrarily be set according to a required bed height of the rising chamber 392. For example, the required bed height of the rising chamber 392 is a height of a fluidized medium fixed bed capable of achieving sealing performance required to hold a pressure in the fluidized-bed separating chamber 390 at a required value. The required bed height of the rising chamber 392 is higher than a height of a surface (not shown) of the fluidized-bed furnace. A height of the lowermost position 317*a* of the incombustible discharge port 317 will hereinafter be referred to as a height of the incombustible discharge port 317.

A required value of pressure in the fluidized-bed separating chamber 390 differs depending on a device connected upstream of the fluidized-bed separating chamber 390. In a case of the fluidized-bed furnace system having the fluidized-bed furnace (not shown) and the incombustible withdrawing system 302*a* according to the present embodiment, the required value is higher than a pressure of an incombustible withdrawing portion (not shown) located near a bottom of the fluidized-bed furnace. The height of the incombustible discharge port 317 may be set to be any value as long as it is higher than the required bed height of the rising chamber 392.

The height of the incombustible discharge port 317 is not limited to the above example in connection with the height of the fluidized medium fixed bed, and may be set to be higher than the above example. For example, the height of the incombustible discharge port 317 may be set to be higher than a position 392*a* vertically 1 m above a floor 390*a* of the fluidized-bed separating chamber 390, and also higher than the height of the fluidized medium fixed bed.

Thus, sealing performance to an exterior of the rising chamber 392 can arbitrarily be designed by adjusting the height of the incombustible discharge port 317. Therefore, the height of the fluidized bed in the fluidized-bed furnace (not shown), which has heretofore been constrained, can be designed more flexibly. Accordingly, the fluidized-bed furnace system (not shown) can be made large more flexibly.

As shown in FIG. 3B, the rising chamber 392 should preferably be provided vertically with an angle of 90° with respect to the ground. Alternatively, in order to maintain delivery efficiency, the rising chamber 392 may be inclined at a rising angle of at least 80°, preferably at least 70°, more preferably at least 60°. When the rising angle is smaller, delivery efficiency of the fluidized medium and the incombustibles can be made higher. The delivery efficiency is in a range of 15 to 20% when the rising chamber 392 is inclined at a rising angle of 60°. If the rising chamber 392 is excessively inclined so as to be substantially horizontal, then the screw conveyor 378 as a fluidized medium delivering device is required to be long in length to reach a predetermined height. Thus, it is not reasonable that the rising chamber 392 is excessively inclined.

On the other hand, in order to maintain separation effects of the fluidized medium, the inclination angle of the rising chamber 392 with respect to a horizontal plane should preferably be at least an angle of repose of the fluidized medium (35°), more preferably at least 60°, more preferably at least 70°, more preferably at least 80°.

When the screw conveyor 378 is used as a fluidized medium delivering device, it is desirable that the inclination angle of the rising chamber 392 is set to be closer to 90° in order to prevent the fluidized medium 310 from flowing into an axial sealing portion of a cantilever support located at an upper portion of the screw conveyor 378 and causing damage to the axial sealing portion.

When the screw conveyor 378 has a screw shaft along a vertical direction, only an upper portion of the screw shaft is positioned at a top of the rising chamber 392 so that the screw shaft is suspended downward. With this arrangement, an axial sealing portion can be eliminated at a lower portion of the rising chamber 392. Even if thermal expansion is caused, only tensile stress is applied to the screw shaft. Further, since a lower end of the screw shaft is swingable, even if a hard and large incombustible flows into the rising chamber 392, the lower end of the screw shaft can be swung to provide a space for the hard and large incombustible.

The fluidized-bed separating chamber 390 receives the mixture 310*b* of the incombustibles and the fluidized medium 310 and separates the incombustibles and the fluidized medium from each other. The second separated mixture 310*f* having a high concentration of the incombustibles ascends through the rising chamber 392. The second mixture 310*f* is then discharged as incombustibles 360 through the incombustible discharge port 317 provided at an upper portion of the rising chamber 392 into a subsequent slagging combustion furnace (not shown) or the like.

A concentration ratio of the incombustibles in the fluidized-bed separating chamber 390 can be adjusted simply by controlling an amount of delivery by the screw conveyor 378 in the rising chamber 392. Specifically, when an amount of movement (rotation) of the screw conveyor 378 in the rising chamber 392 is reduced, a concentration ratio of the incombustibles in the fluidized-bed separating chamber 390 can be increased. Further, when a clearance between a screw of the screw conveyor 378 and a casing of the rising chamber 392 is set to be at least three times a maximum diameter of the fluidized medium (i.e. 0.8 mm), it is expected that the fluidized medium slides downward through the clearance to concentrate the incombustibles. In a conventional incombustible withdrawing system, a fluidized medium is replenished into a fluidized-bed furnace by passing a fluidized medium through a screen which is properly selected. According to the incombustible withdrawing system of the present invention, such a process using a screen can be eliminated by properly setting the above clearance.

A ratio of the incombustibles in the fluidized medium 310 in the fluidized-bed furnace is generally in a range of about 3% to about 5%. The concentration of the incombustibles is deemed to be a concentration for accumulating the incombustibles on a bottom of the fluidized bed 312 so as to maintain a good state of circulating fluidized bed 312. On the other hand, the concentration of the incombustibles at which the fluidized medium 310 can properly be withdrawn by a mechanical device such as a screw conveyor 378 is about 20% when municipal wastes are supplied as combustible wastes 314 (combustible solid) into the fluidized-bed furnace 305. The fluidized medium 310 can be withdrawn at a high concentration of about 30% to about 50% by adjusting properties (size and shape) of the incombustibles through crushing or the like.

Thus, in the present embodiment, since the incombustibles are concentrated in the fluidized-bed separating chamber 390, the amount of second mixture 310*f*, which is a mixture of the incombustibles and the fluidized medium, discharged to an exterior of the system can be reduced to one-tenth or less of that in a conventional system. Further, the amount of second mixture 310*f* withdrawn to the exterior of the fluidized-bed furnace is reduced, and the second mixture 310*f* is cooled. Therefore, it is possible to simplify a cooling system for the fluidized medium. Since an amount of heat released to the exterior of the system is reduced, heat recovery efficiency in the fluidized-bed furnace system in its entirety can be improved.

As described above, when the amount of delivery (rotation) of the screw conveyor 378 in the rising chamber 392 is reduced, it is feared that the second mixture 310*f* of the fluidized medium and the incombustibles flows back to the fluidized-bed separating chamber 390 at a higher ratio. In such a case, it is possible to prevent the second mixture 310*f* from flowing back to the fluidized-bed separating chamber 390 by setting the pressure of the fluidized-bed separating chamber 390 to be higher than the pressure of the rising chamber 392.

In order to increase the pressure of the fluidized-bed separating chamber 390, the amount of fluidizing gas supplied from a side portion of the fluidized medium ascent chamber 391 is reduced, and porosity of a dilute fluidized bed in the fluidized medium ascent chamber 391 is reduced. Further, when the amount of fluidizing gas 331 supplied through the supply ports 330 and 330*a* from the bottom surface 390*b* of the passage portion 390*c* in the fluidized-bed separating chamber 390 is reduced so that a speed of the fluidizing gas 331 is not more than a minimum fluidizing gas speed, viscosity of the fluidized bed in the fluidized-bed separating chamber 390 can be increased so as to prevent the second mixture 310*f* from flowing back to the fluidized-bed separating chamber 390.

Figure 4B:
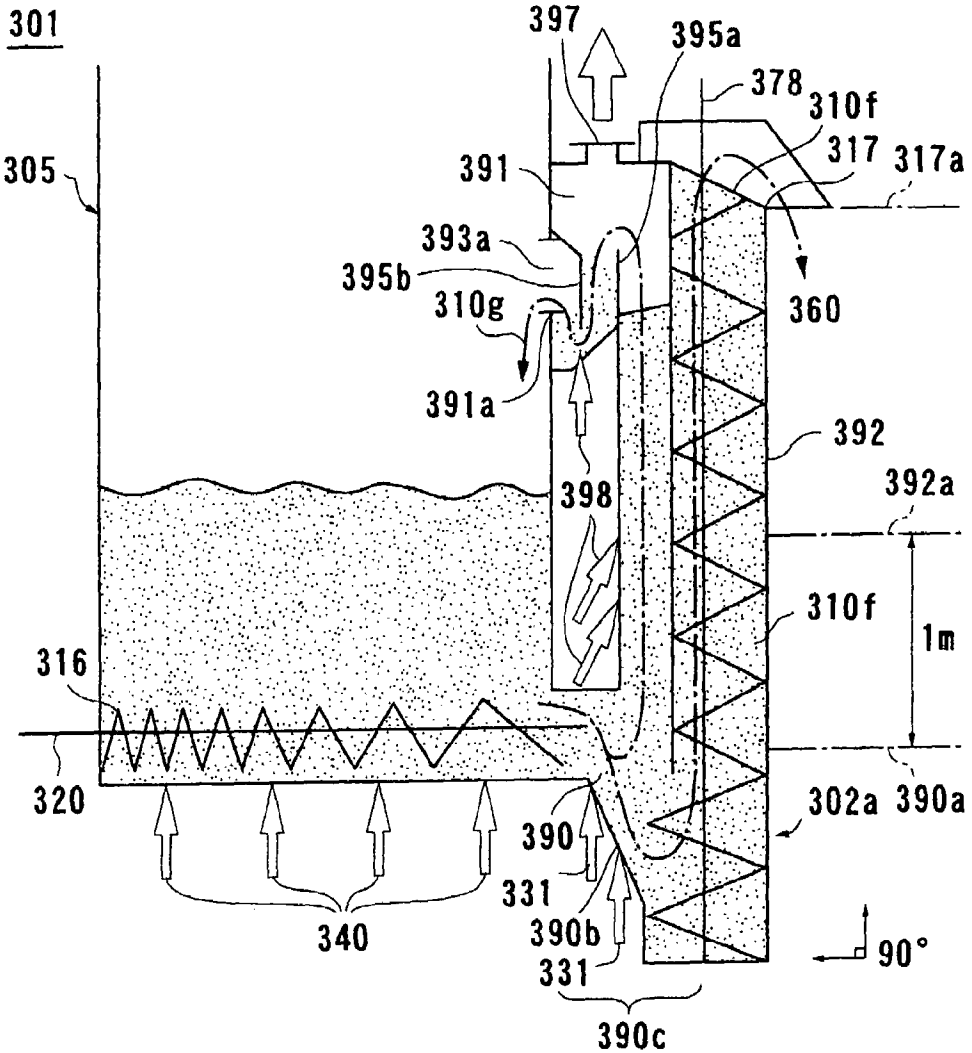
FIGS. 4A and 4B are schematic diagrams showing an incombustible withdrawing system in a fluidized-bed furnace system according to a third embodiment of the present invention.
Figure 4A:
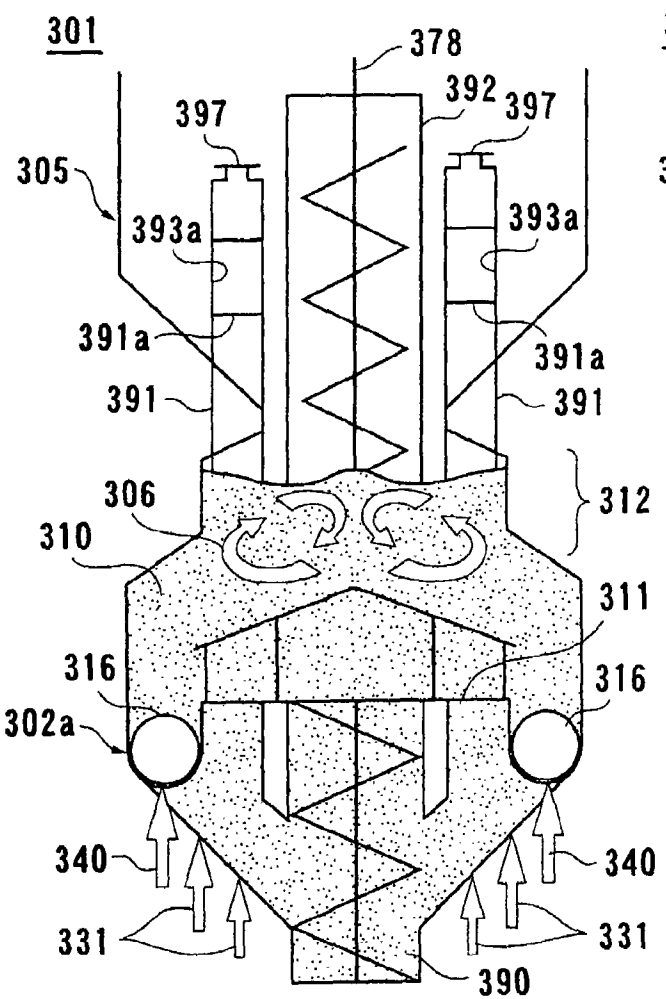

FIGS. 4A and 4B are schematic diagrams showing an incombustible withdrawing system in a fluidized-bed furnace system 301 according to a third embodiment of the present invention. FIG. 4A is a cross-sectional front view of the fluidized-bed furnace system 301, and FIG. 4B is a cross-sectional side view of the fluidized-bed furnace system 301.

The fluidized-bed furnace system 301 has a fluidized-bed furnace 305 holding a fluidized medium 310 therein and an incombustible withdrawing system 302*a*. The fluidized-bed furnace 305 has a circulating fluidized bed 312 for forming circulating fluidization 306 of the fluidized medium 310. The incombustible withdrawing system 302*a* has a mixture delivery path 316 disposed below a bottom of the circulating fluidized bed 312, a fluidized-bed separating chamber 390 provided at a delivery end of the mixture delivery path 316, a fluidized medium ascent chamber 391 provided as a return passage above the fluidized-bed separating chamber 390, and a rising chamber 392 provided as an incombustible discharge passage downstream of the fluidized-bed separating chamber 390. The fluidized-bed separating chamber 390 has a passage portion 390*c* with a bottom surface 390*b*. The passage portion 390*c* and the bottom surface 390*b* are configured in the same manner as in the second embodiment.

Combustible wastes (not shown) are supplied into the fluidized-bed furnace 305. Incombustibles in the combustible wastes are discharged through the mixture delivery path 316 to an exterior of the fluidized-bed furnace 305 together with the fluidized medium 310. A screw conveyor 320 is provided substantially horizontally in the mixture delivery path 316 to introduce a mixture of the incombustibles and the fluidized medium 310 into the fluidized-bed separating chamber 390.

The screw conveyor 320 in the mixture delivery path 316 is rotatably supported. A cooling gas 340 for cooling the fluidized medium is supplied from portions below the screw conveyor 320. Steam is typically used as the cooling gas 340. However, a gas containing oxygen such as air may be used as the cooling gas 340 when the fluidized medium has substantially no unburned combustibles.

The cooling gas 340 is supplied at a flow rate lower than a minimum fluidizing velocity so that the cooling gas 340 is not mixed with a high-temperature fluidized medium 310 located above the circulating fluidized bed 312. In order to enhance a separation function of the screw conveyor 320, it is also effective to supply the cooling gas 340 at a flow rate two to three times the minimum fluidizing velocity. By cooling the fluidized medium 310 located at a lower portion of the circulating fluidized bed 312, the screw conveyor 320 is prevented from being cooled.

Specifically, if the screw conveyor 320 is cooled, moisture is adversely condensed on surfaces of a screw. On the other hand, when concentration of the incombustibles is high, and a large amount of mixture of the incombustibles and the fluidized medium 310 is to be withdrawn, water may be supplied from portions below the screw conveyor 320 instead of the cooling gas 340.

As described above, the fluidized-bed separating chamber 390 moves the incombustibles toward the bottom surface 390*b* and the fluidized medium 310 to an upper portion of the incombustibles by a fluidizing gas 331 supplied from the bottom surface 390*b*, and gently separates the incombustibles and the fluidized medium from each other. A first mixture 310*g* collected to an upper portion of the fluidized-bed separating chamber 390 contains the fluidized medium 310 as a principal component. The first mixture 310*g* is moved to the fluidized medium ascent chamber 391 provided above the fluidized-bed separating chamber 390 according to an upward flow of the fluidizing gas 331. The first mixture 310*g* which has ascended through the fluidized medium ascent chamber 391 flows over loop seals of weirs 395*a* and 395*b* in the fluidized medium ascent chamber 391 and is returned through a return port 393*a* provided at an upper portion of the fluidized-bed furnace 305 to the fluidized-bed furnace 305.

The height of a lowermost position 391*a* of a connecting portion of the return port 393*a* and the fluidized medium ascent chamber 391 is located above an interface of a dense fluidized bed (an upper surface of the circulating fluidized bed 312) so as not to be influenced by pressure fluctuation of the circulating fluidized bed 312 in the fluidized-bed furnace 305. The fluidized medium ascent chamber 391 has weirs 395*a* and 395*b* on the fluidized medium discharge port 393*a*. The weirs 395*a* and 395*b* serve to fill the fluidized medium discharge port 393*a* with the first mixture 310*g* containing the fluidized medium as a principal component and to seal a pressure difference from the fluidized-bed furnace 305 so as to prevent a gas in the fluidized-bed furnace 305 from flowing into the fluidized medium ascent chamber 391.

For example, the fluidized medium ascent chamber 391 may have dispersion nozzles provided at a side wall of the fluidized medium ascent chamber 391 for supplying a fluidizing gas 398 into the fluidized medium ascent chamber 391 to promote ejection of the first mixture 310*g* mainly containing the fluidized medium. The fluidizing gas 398 serves to move the fluidized medium upward. The fluidizing gas 398 can increase and reduce a fluidizing velocity of the fluidizing gas flowing through the fluidized medium ascent chamber 391 to adjust an amount of upward movement of the first mixture 310*g* through the fluidized medium ascent chamber 391.

When the fluidizing velocity in the fluidized medium ascent chamber 391 is increased, concentration of the fluidized medium in the fluidized medium ascent chamber 391 is lowered. Therefore, the first mixture 310*g* can ascend without causing a large pressure increase in the fluidized-bed separating chamber 390.

As described above, the fluidized medium ascent chamber 391 has the fluidizing gas discharge port 397 at the upper portion of the fluidized medium ascent chamber 391. The fluidizing gas 331 supplied from the bottom surface 390*b* of the passage portion 390*c* in the fluidized-bed separating chamber 390 and the fluidizing gas 398 supplied from the side wall of the fluidized medium ascent chamber 391 are discharged through the fluidizing gas discharge port 397. The fluidizing gases 331 and 398 may be used as a secondary combustion gas in the fluidized-bed furnace 305. In such a case, the fluidizing gas discharge port 397 and the fluidized medium return port 393*a* can be integrated with each other, and at least the weir 395*b* can be eliminated.

The fluidizing gas 398 supplied from the side wall of the fluidized medium ascent chamber 391 may comprise the same type of gas as the fluidizing gas 331 supplied from the bottom surface 390*b* of the passage portion 390*c* in the fluidized-bed separating chamber 390, or a gas containing oxygen such as air.

The fluidizing gas 398 supplied from the side wall of the fluidized medium ascent chamber 391 does not flow downward of the fluidized medium ascent chamber 391 unless a pressure balance is lost beyond a large extent. Thus, a gas containing oxygen can be used because it does not cause clinker troubles of the mixture.

Since a gas containing oxygen can be supplied from the side wall of the fluidized medium ascent chamber 391, even if the first mixture 310*g* contains unburned combustibles such as char, the first mixture 310*g* can be combusted in the fluidized medium ascent chamber 391. Therefore, it can be expected that the fluidized medium can be cleaned, and that loss of unburned combustibles can be reduced. Further, a fluidized medium can be increased in temperature by combustion of unburned combustibles in the first mixture 310*g* and returned directly to the fluidized-bed furnace 305. Thus, it is possible to advantageously improve a heat efficiency of the fluidized-bed furnace 305.

On the other hand, the second mixture 310*f* of the fluidized medium and the incombustibles in which the incombustibles are concentrated near the bottom surface 390*b* of the passage portion 390*c* in the fluidized-bed separating chamber 390 is supplied along the bottom surface 390*b* of the passage portion 390*c* into the rising chamber 392. The rising chamber 392 has a fluidized medium delivering device such as a screw conveyor 378 provided in the rising chamber 392 for moving the second mixture 310*f* of the fluidized medium and the incombustibles vertically upward. The second mixture 310*f* is discharged from an incombustible discharge port 317 provided at the upper portion of the rising chamber 392.

A lowermost position 317*a* of the incombustible discharge port 317 can arbitrarily be set according to a required bed height of the rising chamber 392. The required bed height of the rising chamber 392 is the height of a fluidized medium fixed bed capable of achieving sealing performance required to hold a pressure in the fluidized-bed separating chamber 390 to be higher than an internal pressure of the mixture delivery path 316 in the fluidized-bed furnace 305. Typically, the required bed height of the rising chamber 392 is higher than the height of a surface of the circulating fluidized bed 312 (dense fluidized bed).

The height of the lowermost portion 317*a* of the incombustible discharge port 317 is not limited to the above example in connection with the height of the fluidized medium fixed bed and may be set to be higher than the above example. For example, the height of the incombustible discharge port 317 may be set to be higher than a position 392*a* vertically 1 m above a floor 390*a* of the fluidized-bed separating chamber 390, and also higher than the height of the fluidized medium fixed bed.

Thus, sealing performance to an exterior of the rising chamber 392 can arbitrarily be designed by adjusting the height of the incombustible discharge port 317. Therefore, the height of the fluidized bed in the fluidized-bed furnace 305, which has heretofore been constrained, can be designed more flexibly. Accordingly, the fluidized-bed furnace system 301 can be made large more flexibly.

In the rising chamber 392, when an amount of movement (rotation) of the screw conveyor 378 as a fluidized medium delivering device is reduced, a concentration of the incombustibles in the second mixture 310*f* externally discharged can be increased. In this case, it is feared that the second mixture 310*f* in the rising chamber 392 flows back to the fluidized-bed separating chamber 390 at a higher ratio.

In order to prevent the second mixture 310*f* from flowing back to the fluidized-bed separating chamber 390, the amount of fluidizing gas 398 supplied from the side wall of the fluidized medium ascent chamber 391 is reduced, a porosity of a dilute fluidized bed in the fluidized medium ascent chamber 391 is reduced, and a pressure of the fluidized-bed separating chamber 390 is increased. Further, when a moving speed (rotational speed) of the screw conveyor 320 provided in the mixture delivery path 316 is increased, a pressure of the fluidized-bed separating chamber 390 can be increased.

Thus, in the fluidized-bed furnace system 301 according to the present embodiment, since the second mixture 310*f* increased in concentration of the incombustibles is withdrawn, an amount of second mixture 310*f*, which is a mixture of the incombustibles and the fluidized medium, discharged to an exterior of the system can be reduced to one-tenth or less of that in a conventional system.

Further, the second mixture 310*f* of the incombustibles and the fluidized medium to be withdrawn is brought into contact with and directly cooled by the fluidizing gas 331 in the fluidized-bed separating chamber 390. Therefore, the amount of second mixture 310*f* withdrawn to the exterior of the system can be reduced, and simultaneously the second mixture 310*f* can be cooled. Therefore, it is possible to simplify a cooling system for the fluidized medium. Since the amount of heat released to the exterior of the system is reduced, a heat recovery efficiency in the entire fluidized-bed furnace system 301 can be improved.

The present embodiment also has the following advantages. The incombustible discharge port is not provided below the fluidized-bed furnace, unlike the conventional system. Therefore, the height of the fluidized-bed furnace 305 can be reduced as compared to the conventional system. Thus, it is possible to readily install the fluidized-bed furnace 305, without digging a pit for the furnace, on the ground.

Thus, it is possible to reduce a period of time and cost required for installing the fluidized-bed furnace 305 and to simplify structures for installation. All components in the system, including a waste supplying system, i.e. a supplying system for supplying combustible wastes (not shown) into the fluidized-bed furnace 305, are influenced by the fluidized-bed furnace 305 because installation heights of the components can be adjusted according to an installation height of the fluidized-bed furnace 305. Thus, it is possible to remarkably reduce a period of time and cost required for constructing this entire facility.

Figure 5:
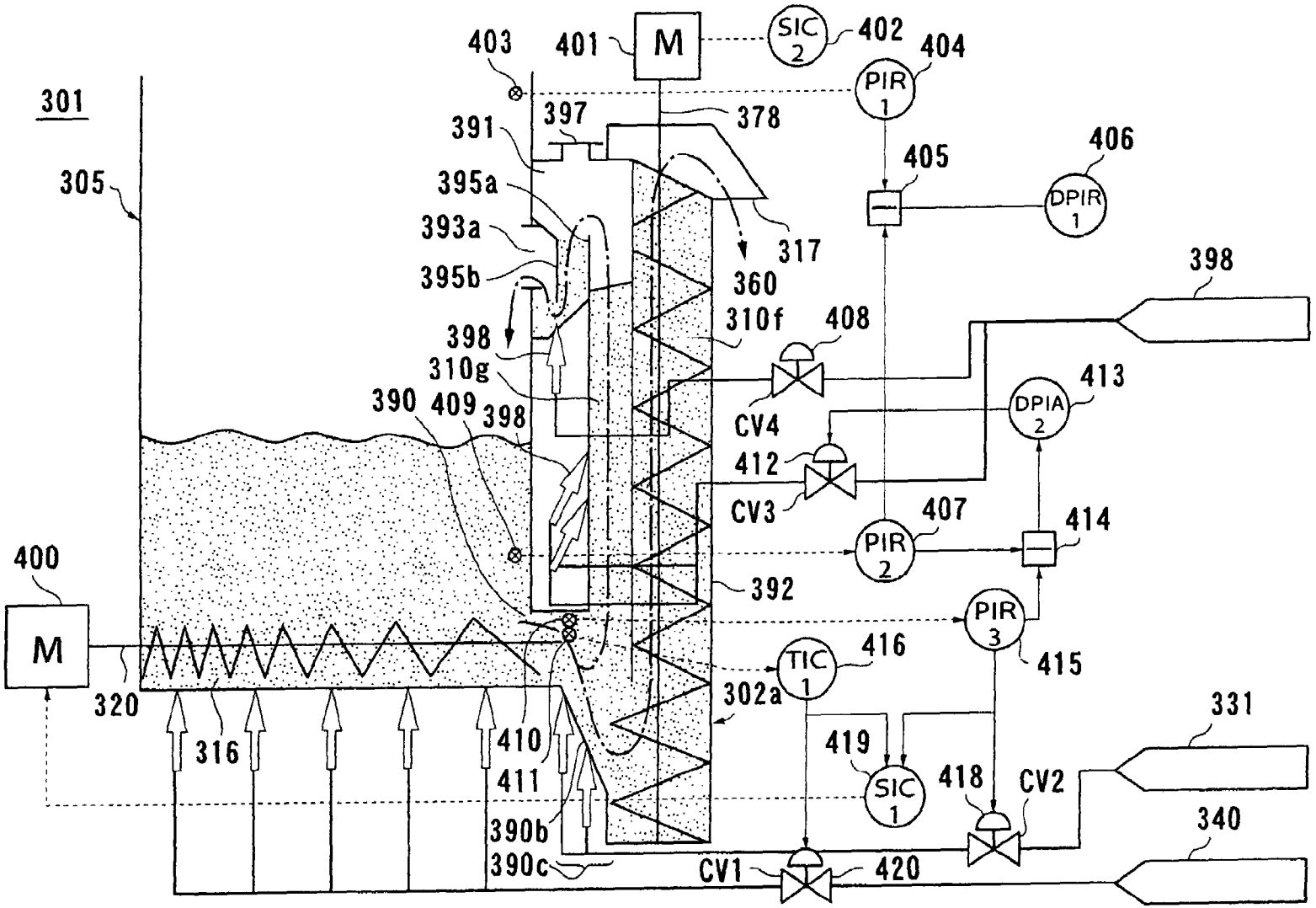
FIG. 5 is a schematic diagram showing an incombustible withdrawing system in a fluidized-bed furnace system according to a fourth embodiment of the present invention.

FIG. 5 is a schematic diagram showing an incombustible withdrawing system in a fluidized-bed furnace system 301 according to a fourth embodiment of the present invention. The fluidized-bed furnace system 301 has a fluidized-bed furnace 305 and an incombustible withdrawing system 302*a*. The incombustible withdrawing system 302*a* has a mixture delivery path 316, a fluidized-bed separating chamber 390, a fluidized medium ascent chamber 391 as a return passage, and a rising chamber 392 as an incombustible discharge passage. The fluidized-bed furnace system 301 also has a first differential pressure gauge 406 for measuring a height of a fluidized bed based on upper and lower pressures of the fluidized-bed furnace 305, a pressure detector 415 for measuring a pressure of the fluidized-bed separating chamber 390 disposed downstream of the fluidized-bed furnace 305, a second differential pressure gauge 413 for measuring a sealing differential pressure based on a lower pressure of the fluidized-bed furnace 305 and a pressure of the fluidized-bed separating chamber 390, a first control valve 420 connected to a temperature controller 416 for supplying a cooling gas 340 to the mixture delivery path 316 disposed below the fluidized-bed furnace 305, a second control valve 418 connected to the pressure detector 415 in the fluidized-bed separating chamber 390 for supplying a fluidizing gas 331 to a bottom surface 390*b* of a passage portion 390*c* in the fluidized-bed separating chamber 390, a third control valve 412 connected to the second differential pressure gauge 413 for supplying a fluidizing gas 398 to a side portion of the fluidized medium ascent chamber 391, a fourth control valve 408 for supplying the fluidizing gas 398 to the vicinity of a weir 395*b* provided at an upper portion of the fluidized medium ascent chamber 391, a temperature controller 416 for controlling a temperature of a fluidized medium in the fluidized-bed separating chamber 390, a screw conveyor 320 rotatably supported for withdrawing a fluidized medium from a bottom of the fluidized-bed furnace 305, a drive motor 400 for driving the screw conveyor 320, a first rotational speed controller 419 for controlling a rotational speed of the drive motor 400 in response to a control signal from the temperature controller 416 and the pressure detector 415 in the fluidized-bed separating chamber 390, a screw conveyor 378 rotatably disposed as a fluidized medium delivering device in the rising chamber 392 downstream of the fluidized-bed separating chamber 390, a drive motor 401 for driving the screw conveyor 378, and a second rotational speed controller 402 for controlling a rotational speed of the drive motor 401. Now, operation of the fluidized-bed furnace system 301 will be described below with reference to FIG. 5.

The first differential pressure gauge 406 is connected to a first pressure detector 404 for measuring pressure of an upper portion of the fluidized-bed furnace 305, and to a second pressure detector 407 for measuring a pressure of a bottom of the fluidized-bed furnace 305. The first differential pressure gauge 406 measures a height of the fluidized bed based on the pressures of the upper portion and the bottom of the fluidized-bed furnace 305 which are sent from the first and second pressure detectors 404 and 407.

The second differential pressure gauge 413 measures a sealing pressure based on the pressure of the bottom of the fluidized-bed furnace 305 which is sent from the second pressure detector 407, and the pressure of the separating chamber 390 which is sent from the third pressure detector 415. The second differential pressure gauge 413 also controls opening and closing of the third control valve 412 based on this measured data.

The third pressure detector 415 measures a pressure of the fluidized-bed separating chamber 390, which receives a fluidized medium withdrawn from the bottom of the fluidized-bed furnace 305 and controls opening and closing of the second control valve 418.

The rotational speed controller 419 (SIC1) sends a rotational speed control signal to the drive motor 400 to rotate the drive motor 400. Thus, the rotational speed controller 419 controls rotation of the screw conveyor 320, which has a rotational shaft extending horizontally.

The temperature controller 416 (TIC1) detects a temperature of a fluidized medium at a portion 411 at which a fluidized medium is introduced from a delivery end of the screw conveyor 320 into the fluidized-bed separating chamber 390. The temperature controller 416 sends a control signal corresponding to this detected signal to the control valve 420 (CV1) as a first control valve to control an amount of cooling gas 340 for cooling a fluidized medium supplied from a plurality of supply ports provided at a bottom of the screw conveyor 320.

Thus, the temperature of the fluidized medium at the portion 411 at which the fluidized medium is introduced into the fluidized-bed separating chamber 390 is maintained below 450° C. by the cooling gas 340 thus controlled. In the present embodiment, steam is used as the cooling gas 340. A similar controlling method can be applied to a case where water is used as a cooling agent instead of steam. When an amount of unburned carbon is small in the fluidized medium, a gas containing oxygen, such as air or combustion exhaust gas, may be used as the cooling gas 340.

The pressure detector 407 (PIR2) obtains a pressure of an interior 409 of the circulating fluidized bed. The pressure detector 415 (PIR3) obtains a pressure of a portion 410 at which a fluidized medium is introduced into the fluidized-bed separating chamber 390. The pressure obtained by the pressure detector 407 and the pressure obtained by the pressure detector 415 are inputted into a subtracter 414 to produce a differential pressure between the interior 409 and the portion 410. The differential pressure is then inputted into the differential pressure gauge 413 (DPIA2). The differential pressure gauge 413 controls the control valve 412 (CV3) so that the pressure (PIR3) of the portion 410 is continuously maintained to be higher than the pressure (PIR2) of the interior (bottom) 409 of the circulating fluidized bed.

Specifically, the pressures of the fluidized-bed furnace 305 and the fluidized-bed separating chamber 390 are continuously monitored by the differential pressure gauge 413. A relationship between the pressures of the portion 410 and the interior 409 of the circulating fluidized bed is adjusted mainly by controlling the control valve 412 for a fluidizing gas supplied from the side portion of the fluidized medium ascent chamber 391 so as to reduce the amount of fluidizing gas. In the present embodiment, air may be used as the fluidizing gas 398.

If the pressure (PIR3) of the portion 410 at which the fluidized medium is introduced from the screw conveyor 320 into the fluidized-bed separating chamber 390 becomes lower than an administrative value, the second mixture 310*f* may flow back from the rising chamber 392. Therefore, when the pressure (PIR3) of the portion 410 is lower than a predetermined value, the control valve 418 (CV2) is throttled to control an amount of fluidizing gas 331 to be supplied from the bottom surface 390*b* into the passage portion 390*c* in the fluidized-bed separating chamber 390. Thus, fluidization of the fluidized-bed separating chamber 390 is weakened so as to prevent the second mixture 310*f* from flowing back from the rising chamber 392. Alternatively, the rotational speed controller 419 controls the screw conveyor 320 to increase a rotational speed of the screw conveyor 320. Thus, an amount of movement of the fluidized medium is increased so as to prevent the second mixture 310*f* from flowing back from the rising chamber 392.

When the rotational speed of the screw conveyor 320 is increased, a temperature (TIC1) at the portion 410 is increased above a predetermined value. Therefore, it is advantageous that the amount of fluidizing gas 331 supplied from the bottom surface 390*b* of the passage portion 390*c* in the fluidized-bed separating chamber 390 is first reduced to weaken fluidization of the mixture.

The first differential pressure gauge 406 (DPIR1) is connected to the first pressure detector 404 (PIR1) and the second pressure detector 407 (PIR2) through a subtracter 405. The first differential pressure gauge 406 detects a differential pressure between the pressure (PIR1) of an upper portion 403 of a freeboard of the fluidized-bed furnace 5 and the pressure (PIR2) of the interior (bottom) 409 of the circulating fluidized bed, and monitors a height of the circulating fluidized bed.

When the fourth control valve 408 (CV4) is opened, a fluidizing gas 398 (air) is supplied into a loop seal provided upstream of the return port 393*a* to return the fluidized medium from the fluidized medium ascent chamber 391 into the fluidized-bed furnace 305. The loop seal serves to partition the fluidized medium ascent chamber 391 and the fluidized-bed furnace 305, and includes weirs 395*a* and 395*b* provided at an upper portion of the fluidized medium ascent chamber 391. The loop seal is basically supplied with air as the fluidizing gas 398 at a fixed flow rate. For example, the flow rate is fixed to be about two times a minimum fluidizing velocity.

The screw conveyor 378 is suspended from and cantilevered at a top of the rising chamber 392. The drive motor 401 is connected to the screw conveyor 378. The second rotational speed controller 402 (SIC2) sends a rotational speed control signal to the drive motor 401 to rotate drive motor 401. Thus, the second rotational speed controller 402 controls rotation of the screw conveyor 378. The screw conveyor 378 is usually operated at a fixed rotational speed.

In the present embodiment, the bottom surface 390*b* is inclined downward to the rising chamber 392. The passage portion 390*c* has a vertical cross-section gradually widened toward the rising chamber 392. With such an arrangement, the mixture can smoothly be delivered to a lower portion of the rising chamber 392.

The fluidizing gas 331 is supplied from the bottom surface 390*b* of the passage portion 390*c* in the fluidized-bed separating chamber 390 so as to form a dilute fluidized bed at an upper portion of the fluidized-bed separating chamber 390. The fluidizing gas 398 is supplied from an intermediate portion of the fluidized medium ascent chamber 391. A return port 393*a* is provided, as an opening communicated with the fluidized-bed furnace 305, at an upper portion of the fluidized medium ascent chamber 391. The first mixture 310*g* mainly containing a fluidized medium ejected in the fluidized medium ascent chamber 391 is returned through the return port 393*a* to the fluidized-bed furnace 305.

Figure 6:
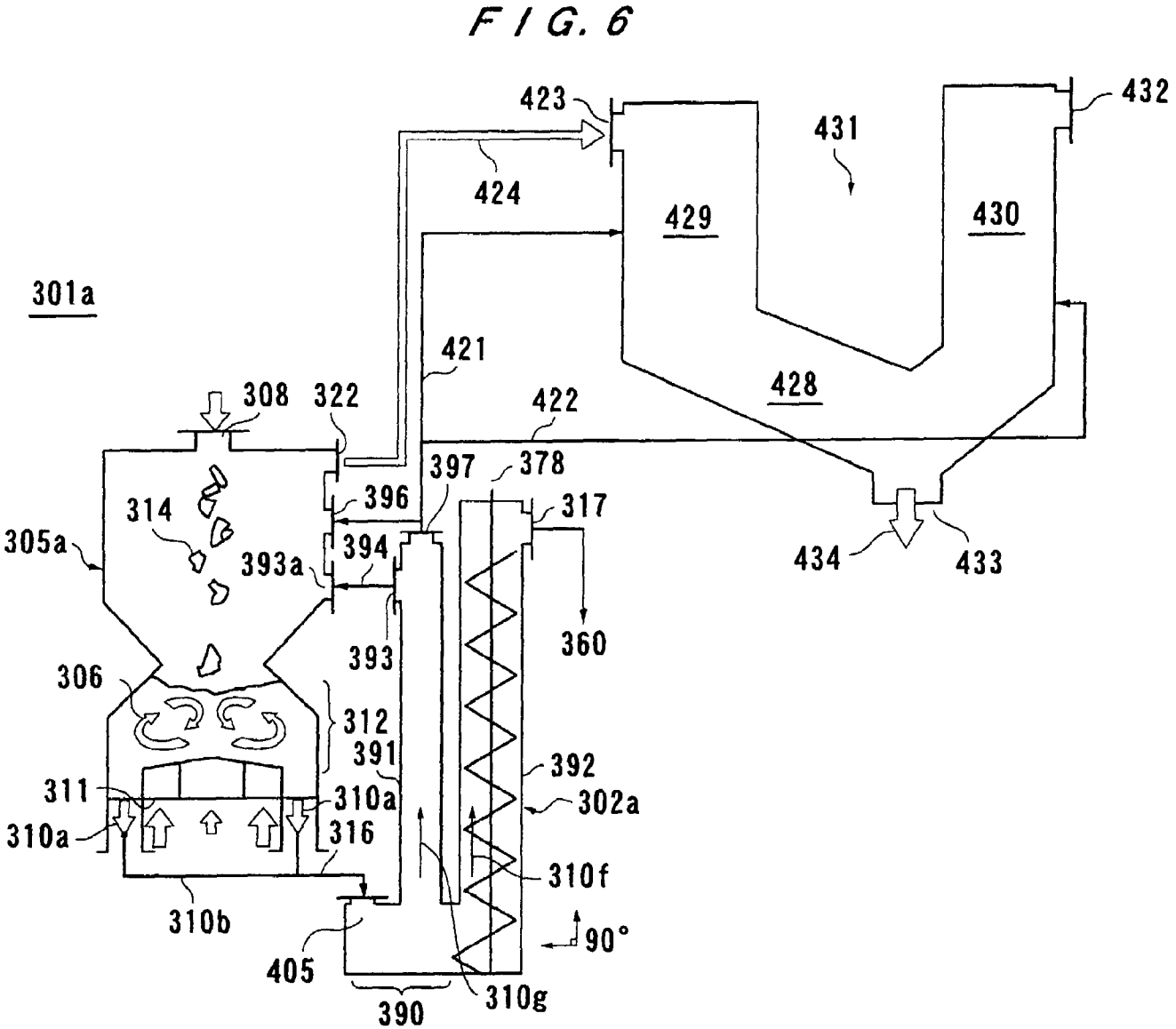
FIG. 6 is a schematic diagram showing an incombustible withdrawing system in a fluidized-bed gasification and slagging combustion furnace system according to a fifth embodiment of the present invention.

FIG. 6 is a schematic diagram showing an incombustible withdrawing system in a fluidized-bed gasification and slagging combustion furnace system 301*a* according to a fifth embodiment of the present invention. The fluidized-bed gasification and slagging combustion furnace system 301*a* has a fluidized-bed gasification furnace 305*a* as a fluidized-bed furnace, and an incombustible withdrawing system 302*a*. The incombustible withdrawing system 302*a* has a mixture delivery path 316 disposed below the fluidized-bed gasification furnace 305*a*, a fluidized medium ascent chamber 391 as a return passage provided downstream of the mixture delivery path 316, a rising chamber 392 as an incombustible discharge passage, and a slagging combustion furnace 431 connected downward to a discharge duct 322 of the fluidized-bed gasification furnace 305*a*. The fluidized-bed gasification furnace 305*a*, the mixture delivery path 316, the fluidized medium ascent chamber 391, and the rising chamber 392 have the same structures as in the first embodiment and will not be described repetitively. The fluidized-bed gasification furnace 305*a* shown in FIG. 6 corresponds to the fluidized-bed furnace 305 shown in FIG. 2.

The slagging combustion furnace 431 has a primary chamber 429, a secondary chamber 428, and a tertiary chamber 430. A pyrolyzed gas is introduced from the discharge duct 322 of the fluidized-bed gasification furnace 305*a* through a pipe 424 into a gas introduction port 423. The pyrolyzed gas is completely combusted in the primary chamber 429 and the secondary chamber 428 to melt ash into slag. An unburned combustible gas is completely combusted in the tertiary chamber 430.

It is desirable that an exhaust gas from the fluidized medium ascent chamber 391 is supplied from the fluidizing gas discharge port 397 through a pipe 422 into the tertiary chamber 430 of the slagging combustion furnace 431. Since the exhaust gas from the fluidized medium ascent chamber 391 has a low concentration of oxygen, it is not suitable as an oxidizing agent for combustion. If the exhaust gas from the fluidized medium ascent chamber 391 is supplied to the fluidized-bed gasification furnace 305*a*, or to the primary chamber 429, or the secondary chamber 428 of the slagging combustion furnace 431, it inhibits temperature rising required to melt ash into slag.

The present invention is not limited to an arrangement in which the exhaust gas is supplied through the pipe 422 to the tertiary chamber 430 of the slagging combustion furnace 431. For example, since an exhaust gas from the fluidized medium ascent chamber 391 has been heated to about 500° C. by heat exchange with a fluidized medium, the exhaust gas from the fluidized medium ascent chamber 391 has less adverse influence on temperature rising. Thus, if the exhaust gas from the fluidized medium ascent chamber 391 has an oxygen concentration of at least 15%, it may be supplied through a pipe 421 into the primary chamber 429 or the secondary chamber 428 of the slagging combustion furnace 431. When an amount of unburned combustibles in the fluidized medium is small, a fluidized-bed furnace system can have such an arrangement. In either case, the present invention has great advantages as compared to a conventional system which withdraws a fluidized medium having a high temperature and processes the fluidized medium with heat loss.

In the slagging combustion furnace 431, the pyrolyzed gas is melted into slag in the primary chamber 429 and the secondary chamber 428, and the slag drops onto a bottom 433 of the slagging combustion furnace 431. The slag 434 on this furnace bottom 433 is discharged from the furnace bottom 433.

As described above, the fluidized-bed gasification and slagging combustion furnace system 301*a* in the present embodiment has the rising chamber 392 provided downstream of the fluidized-bed separating chamber 390 to deliver a second mixture 310*f* of the fluidized medium and the incombustibles in an upward direction. Thus, the second mixture 310*f* having a high concentration of incombustibles can be discharged to an exterior of the system from a position higher than a surface of a circulating fluidized bed 312 (dense fluidized bed) of the fluidized-bed gasification furnace 305*a*.

In the present embodiment, it is desirable that a suspension-type screw conveyor 378 for moving the second mixture 310*f* in a vertically upward direction is used as a fluidized medium delivering device provided within the rising chamber 392, which has substantially a cylindrical wall having an angle of about 90° with respect to the horizontal plane.

Figure 7:
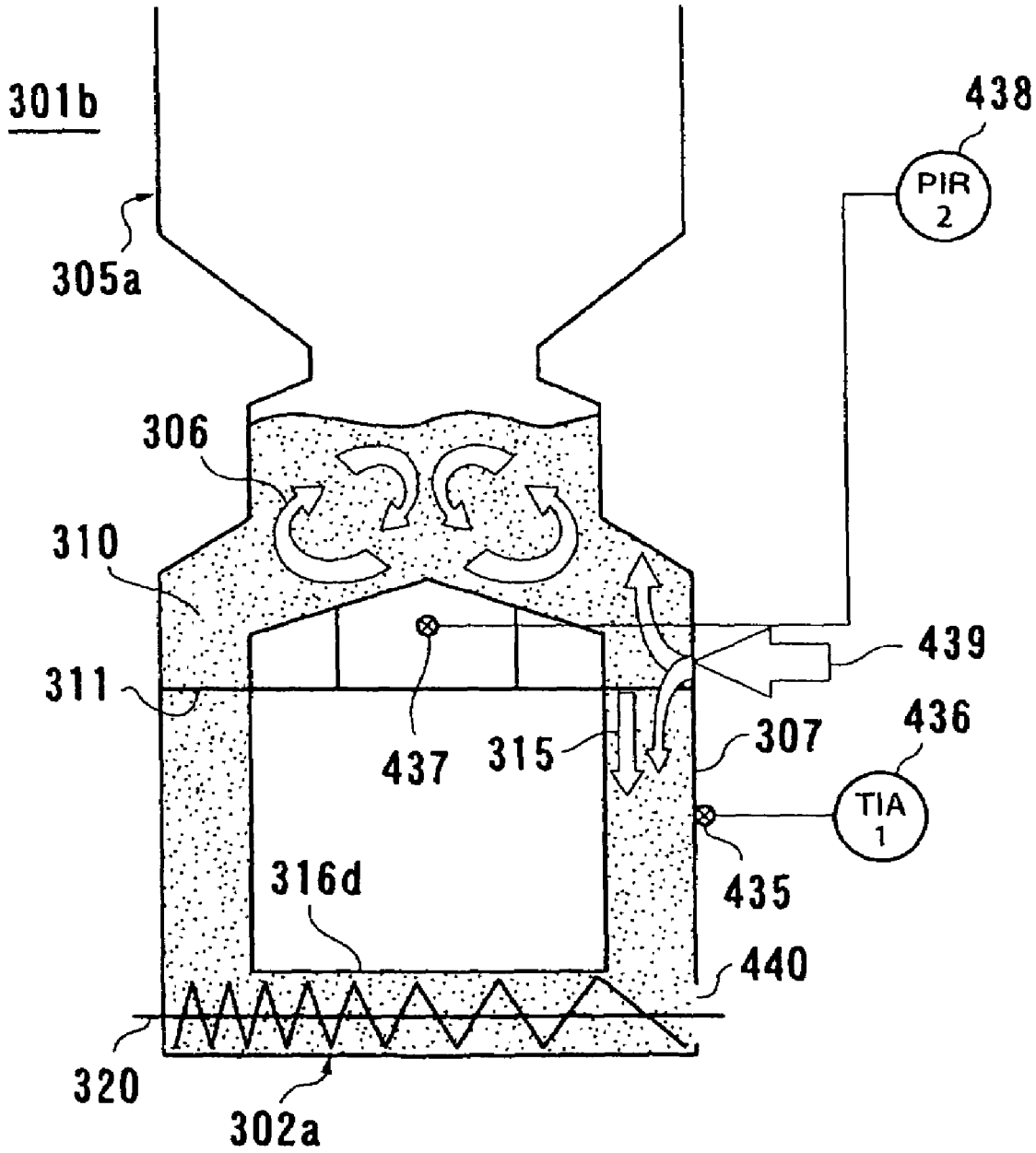
FIG. 7 is a schematic diagram showing an incombustible withdrawing system in a fluidized-bed gasification furnace system according to a sixth embodiment of the present invention.

FIG. 7 is a schematic diagram showing an incombustible withdrawing system in a fluidized-bed gasification furnace system 301*b* according to a sixth embodiment of the present invention. The fluidized-bed gasification furnace system 301*b* has a fluidized-bed gasification furnace 305*a* and an incombustible withdrawing system 302*a* (partly shown). The fluidized-bed gasification furnace 305*a* holds a fluidized medium 310 therein which forms circulating fluidization 306 substantially in a cylindrical receptacle. The incombustible withdrawing system 302*a* has an incombustible withdrawing chute 307 as a mixture delivery path for withdrawing the fluidized medium 310 forming the circulating fluidization 306 from a furnace bottom 311, a horizontal fluidized medium withdrawing path 316*d* as a mixture delivery path provided below the incombustible withdrawing chute 307, and a screw conveyor 320 provided in the horizontal fluidized medium withdrawing path 316*d*. The horizontal fluidized medium withdrawing path 316*d* includes a mixture discharge port 440 formed near a delivery end of the screw conveyor 320. The incombustible withdrawing system 302*a* also has a fluidized-bed separating chamber (not shown) for receiving a mixture of the fluidized medium and incombustibles which are discharged from the mixture discharge port 440, a fluidized medium ascent chamber (not shown) as a return passage, and a rising chamber (not shown) as an incombustible discharge passage. The fluidized-bed gasification furnace system 301*b* has a pressure sensor 437 provided at a region to which a gas is supplied to form the circulating fluidization 306 of the fluidized medium, a temperature sensor 435 provided on an outer wall of the incombustible withdrawing chute 307, a pressure measuring device 438 (PIR2) connected to the pressure sensor 437 for measuring a pressure of a bottom of the fluidized-bed gasification furnace 305*a*, and a temperature measuring device 436 (TIA) connected to the temperature sensor 435 for detecting a temperature of the outer wall of the incombustible withdrawing chute 307.

In FIG. 7, a portion 315 near an inlet of the incombustible withdrawing chute 307 has a high partial pressure of oxygen. Accordingly, the incombustibles and the fluidized medium are likely to be increased in temperature. Therefore, steam 439 is supplied as a purge gas from a side surface near the portion 315 to fluidize the portion 315 in the incombustible withdrawing chute 307, thereby preventing clinker from being produced. The purge gas 439 also serves to cool the incombustible withdrawing chute 307 to lower temperatures of the fluidized medium and the incombustibles.

The pressure measuring device 438 (PIR2) measures a pressure of the fluidized-bed furnace 305*a* and controls a pressure of the purge gas 439 so that a pressure of the incombustible withdrawing chute 307 is higher than a pressure of the fluidized-bed furnace 305*a*.

Further, the temperature measuring device 436 detects the temperature of the outer wall of the incombustible withdrawing chute 307 and monitors the temperature of the incombustible withdrawing chute 307 so as not to qualitatively exceed a clinker producing temperature. If the temperature sensor 435 connected to the temperature measuring device 436 is projected from the sidewall into the incombustible withdrawing chute 307, it prevents the fluidized medium and the incombustibles from flowing down due to gravity and from being discharged. Therefore, the temperature sensor 435 is provided on the outer wall of the incombustible withdrawing chute 307, and the temperature measuring device 436 detects the temperature of the outer wall of the incombustible withdrawing chute 307.

Figure 8:
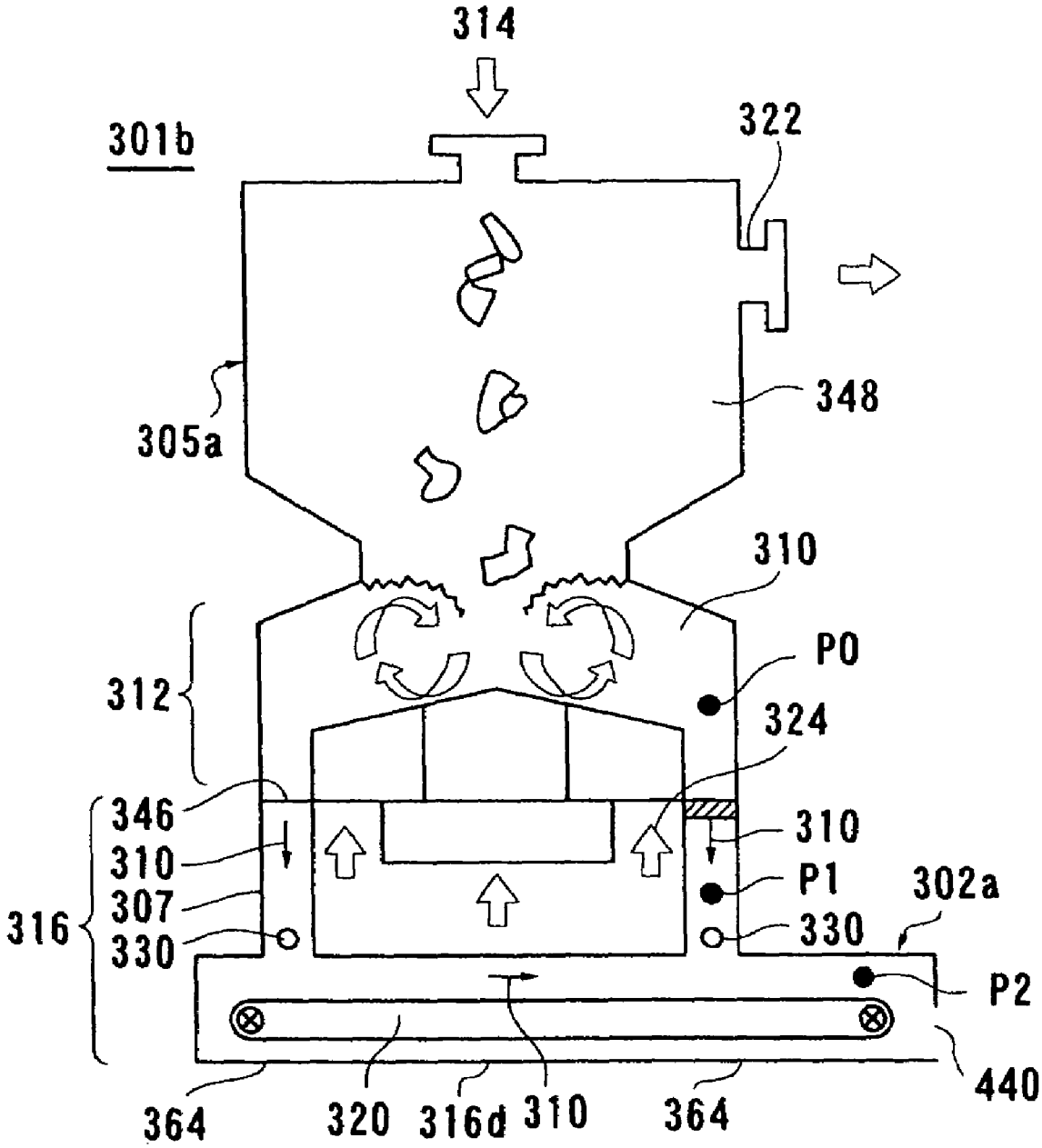
FIG. 8 is a schematic diagram showing an incombustible withdrawing system in a fluidized-bed gasification furnace system according to a seventh embodiment of the present invention.

FIG. 8 is a schematic diagram showing an incombustible withdrawing system in a fluidized-bed gasification furnace system 301*b* according to a seventh embodiment of the present invention. The fluidized-bed gasification furnace system 301*b* has a fluidized-bed gasification furnace 305*a* and an incombustible withdrawing system 302*a* (partly shown). The fluidized-bed gasification furnace 305*a* has a circulating fluidized bed 312 and a freeboard 348, which are located above a furnace bottom 346. The incombustible withdrawing system 302*a* has a fluidized medium withdrawing path 316 as a mixture delivery path disposed below the furnace bottom 346, and a screw conveyor 320 disposed in a lower horizontal portion 316*d* of the fluidized medium withdrawing path 316. The incombustible withdrawing system 302*a* also has a fluidized-bed separating chamber (not shown) for receiving a mixture of a fluidized medium and incombustibles which is discharged from a mixture discharge port 440, and a fluidized medium ascent chamber (not shown) as a return passage, and a rising chamber (not shown) as an incombustible discharge passage. The fluidized medium withdrawing path 316 has the mixture discharge port 440 provided on the lower horizontal portion 316*d* near a delivery end of the screw conveyor 320. The fluidized medium withdrawing path 316 includes an incombustible withdrawing chute 307 provided in a vertical direction and the lower horizontal portion 316*d*.

Combustion air 324 having a high temperature is supplied from the furnace bottom 346. The combustion air 324 produces an internal revolving flow of the fluidized medium 310 in the circulating fluidized bed 312. Wastes 314 are supplied into the fluidized-bed gasification furnace 305*a* and brought into contact with the circulating fluidized bed 312 having a temperature of 450° C. to 650° C. Thus, the wastes 314 are pyrolyzed and gasified to produce a combustible gas. The combustible gas is discharged as an exhaust gas from the discharge duct 322 provided at an upper portion of the freeboard 348 to an exterior of the fluidized-bed gasification furnace 305*a*.

The fluidized medium withdrawing path 316 serves to withdraw the fluidized medium 310 from the furnace bottom 346 and deliver the fluidized medium 310 toward the right side in FIG. 8 in a horizontal direction by the screw conveyor 320. This delivered fluidized medium 310 is discharged from the mixture discharge port 440 and delivered to the fluidized-bed separating chamber (not shown).

Purge gas supply ports 330 are provided between a lowermost portion 364 of the fluidized medium withdrawing path 316 and the furnace bottom 346 for supplying a purge gas such as steam. For example, when an internal pressure P0 of the circulating fluidized bed 312 is set to be 15 kPa, a purge gas is supplied from the purge gas supply ports 330 so that pressure P1 near the purge gas supply ports 330 is about 17 kPa, which is higher than pressure P0.

Pressure P2 near an outlet of the fluidized medium withdrawing path 316 can be maintained to be several kilopascal, which is slightly higher than an atmospheric pressure, by sealing performance of a fluidized medium ascent chamber (not shown) and a rising chamber (not shown). The pressure P2 near the outlet of the fluidized medium withdrawing path 316 may be an atmospheric pressure as long as the pressure P1 near the purge gas supply ports 330 can be maintained to be about 17 kPa.

Under the above pressure conditions, a purge gas is supplied from the purge gas supply ports 330 into the fluidized medium withdrawing path 316 to purge a combustion gas 324 and an unburned gas contained in the fluidized medium 310 from the fluidized medium withdrawing path 316 and the vicinity of a bottom of the circulating fluidized bed 312.

In this case, the following relationship should be maintained between the internal pressure P0 of the circulating fluidized bed 312, the internal pressure P1 of the fluidized medium withdrawing path 316, and the internal pressure P2 near the discharge port of the fluidized medium withdrawing path 316.

$$P0<P1>P2$$

In the present embodiment, when the purge gas is supplied from the purge gas supply ports 330, an outlet of the fluidized medium withdrawing path 316 may be hermetically sealed by the fluidized medium ascent chamber (not shown) and the rising chamber (not shown) to maintain the above relationship (P0<P1>P2).

In the present embodiment, a belt conveyor or a chain conveyor may be used instead of screw conveyor 320 provided in the fluidized medium withdrawing path 316. Further, silica sand may be used as the fluidized medium 310.

An inert gas such as a nitrogen gas or carbon dioxide may be used as the purge gas. Such a nitrogen gas or carbon dioxide produces no moisture even if the purge gas is cooled in the fluidized medium withdrawing path 316. Thus, such a nitrogen gas or carbon dioxide can maintain a dry environment and does not produce smoke (steam) even if it is released to an exterior of the fluidized medium withdrawing path 316.

Since the mixture of the fluidized medium and the incombustibles is cooled, the fluidized medium ascent chamber (not shown) and the rising chamber (not shown) as the incombustible discharge passage can have margins in their design, so that sealing performance can effectively be maintained.

Therefore, it is not necessary to lengthen the incombustible withdrawing chute 307 in order to ensure material sealing effects of the mixture. Even if the incombustible withdrawing chute 307 is installed on the ground, the fluidized-bed gasification furnace 305*a* can have a reduced height as compared to a conventional system. Thus, it is possible to reduce cost for installation of the fluidized-bed furnace system.

Figure 9:
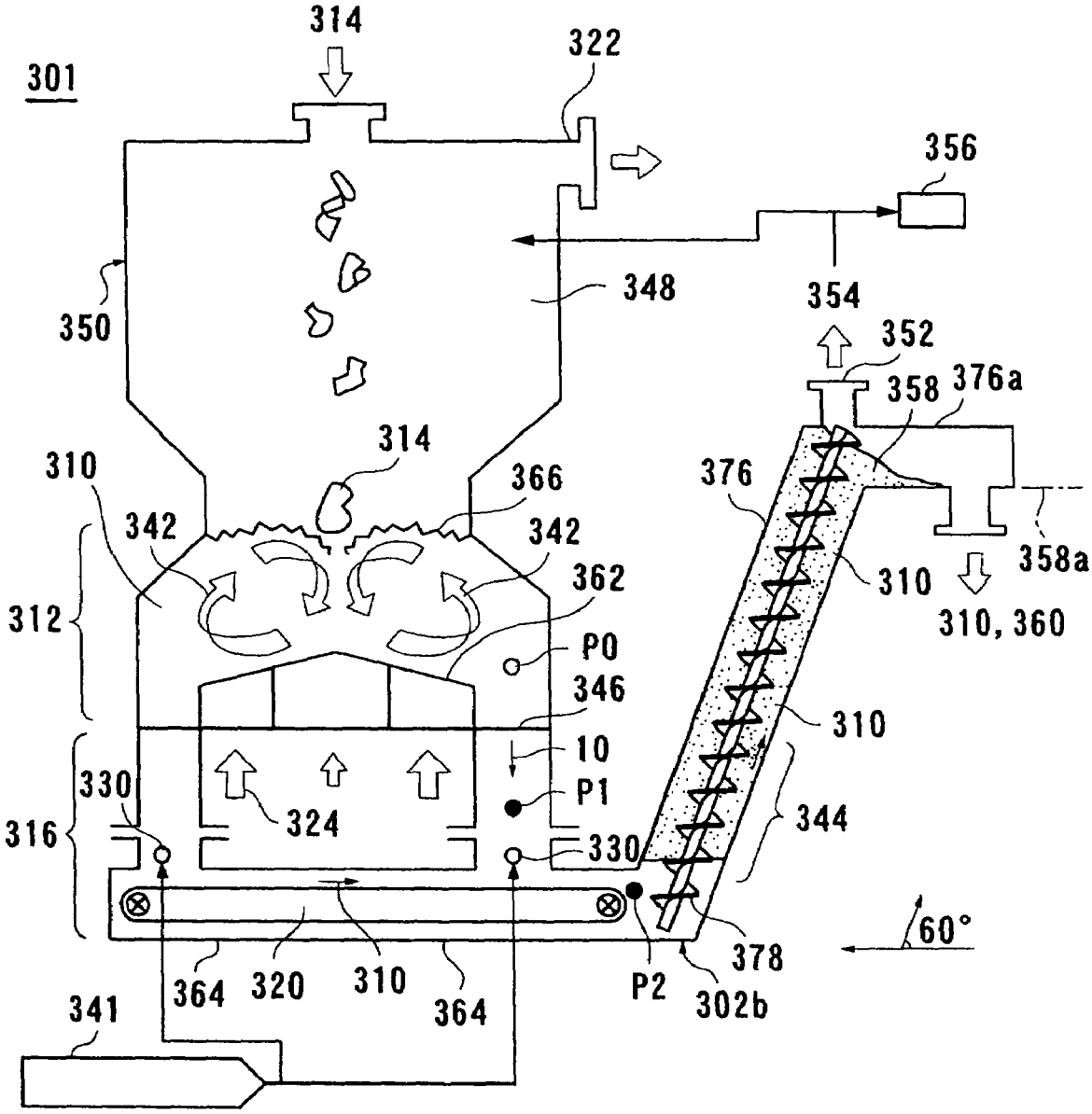
FIG. 9 is a schematic diagram showing an incombustible withdrawing system in a fluidized-bed furnace system according to an eighth embodiment of the present invention.

FIG. 9 is a schematic diagram showing an incombustible withdrawing system in a fluidized-bed furnace system 301 according to an eighth embodiment of the present invention. The fluidized-bed furnace system 301 has a fluidized-bed furnace 350 and an incombustible withdrawing system 302*b*. The fluidized-bed furnace 350 has a circulating fluidized bed 342 formed above a bottom 346 of the fluidized-bed furnace 350, and a freeboard 348. The incombustible withdrawing system 302*b* has a fluidized medium withdrawing path 316 as a mixture delivery path disposed below furnace bottom 346, a path 376 as an incombustible discharge passage, and a horizontal path 376*a* as an incombustible discharge passage connected to an upper portion of the path 376. The path 376 has a rising portion 344 inclined at 30° with respect to a vertical direction, a discharge duct 352, and an incombustible discharge port 358 for discharging a fluidized medium 310 and incombustibles 360 from the path 376. The rising portion 344 is filled with a mixture of the fluidized medium 310 and the incombustibles 360. The fluidized medium 310 and the incombustibles 360 are discharged from the path 376 through the incombustible discharge port 358, introduced into the horizontal path 376*a*, and then discharged to an exterior of the system.

In the circulating fluidized bed 312, combustion air 324 having a high temperature is supplied from the furnace bottom 346 through a diffusion plate 362 to produce an internal revolving flow 342 of the fluidized medium. The fluidized-bed furnace 350 and the fluidized medium withdrawing path 316 can have the same arrangements as in the seventh embodiment and will not be described repetitively.

The incombustible discharge port 358 is provided at an end of the rising portion 344 in the path 376. The mixture is discharged from the path 376 through the incombustible discharge port 358 in the horizontal direction. A lowermost position 358*a* of the incombustible discharge port 358 is located at a higher position than a top or an average height of a surface 366 of the circulating fluidized bed 312 so that the fluidized medium 310 is filled or accumulated in the rising portion 344 up to the incombustible discharge port 358 of the path 376 due to its gravity.

The incombustible withdrawing system 302*b* also has a screw conveyor 378 disposed as a fluidized medium delivering device in the path 376. The screw conveyor 378 has a shaft. The fluidized medium 310 delivered to a bottom of the path 376 is involved in the rotating screw conveyor 378 and delivered to an upper portion of the path 376 by the screw conveyor 378.

The fluidized medium 310 in the path 376 is filled or accumulated in the rising portion 344 of the path 376. This filled fluidized medium 310 can maintain sealing performance to prevent pressure P1 near the purge gas supply ports 330, from which a purge gas 341 is supplied, from being lowered.

Instead of a double damper or a lock hopper as a sealing device, the fluidized medium 310 is filled into the rising portion 344 of the path 376. Thus, sealing effects can be improved. Simultaneously, it is not necessary to dig a pit for receiving a double damper below the fluidized medium withdrawing path 316, and thus a height of the fluidized-bed furnace system 301 can be reduced. Accordingly, it is possible to reduce a period of time and cost required for installing the fluidized-bed furnace system 301.

The purge gas 341 can prevent an unburned gas contained in the circulating fluidized bed 312 from being introduced into an introduction portion of the fluidized medium withdrawing path 316 or the path 376. It is not necessary to provide a special sealing device for preventing leakage of a purge gas. Therefore, it is possible to simplify a process of digging a pit for receiving such a sealing device. Accordingly, the fluidized-bed furnace 350 can be installed at a lower position as compared to a conventional system, and it is possible to reduce cost for framing the fluidized-bed furnace 350.

The fluidized medium 310 discharged from the path 376 is then discharged through the horizontal path 376*a* to an exterior of the incombustible discharge port 358. This discharged fluidized medium 310 and the incombustibles 360 are subjected to a separation process in a slagging combustion furnace (not shown) or the like, which is provided outside of the fluidized-bed furnace 350 for processing incombustibles. Then, the fluidized medium 310 and the incombustibles 360 are recovered, respectively.

On the other hand, the purge gas 341 is discharged from the discharge duct 352 and supplied through a supply path 354 to an exhaust boiler 356. Thus, the purge gas 341 can be reused as a heat source. Further, a portion of steam discharged from the discharge duct 352 is supplied to the freeboard 348 so that a water-gas reaction occurs with a combustible gas in the freeboard 348. An endothermic reaction in the water-gas reaction can lower a temperature of the freeboard 348 to a proper value.

Thus, in the present embodiment, it is desirable that the fluidized medium delivering device provided in the path 376 comprises a screw conveyor 378 for delivering the mixture in an inclined direction having an interior angle of at least 60° with respect to the horizontal plane.

Figure 10:
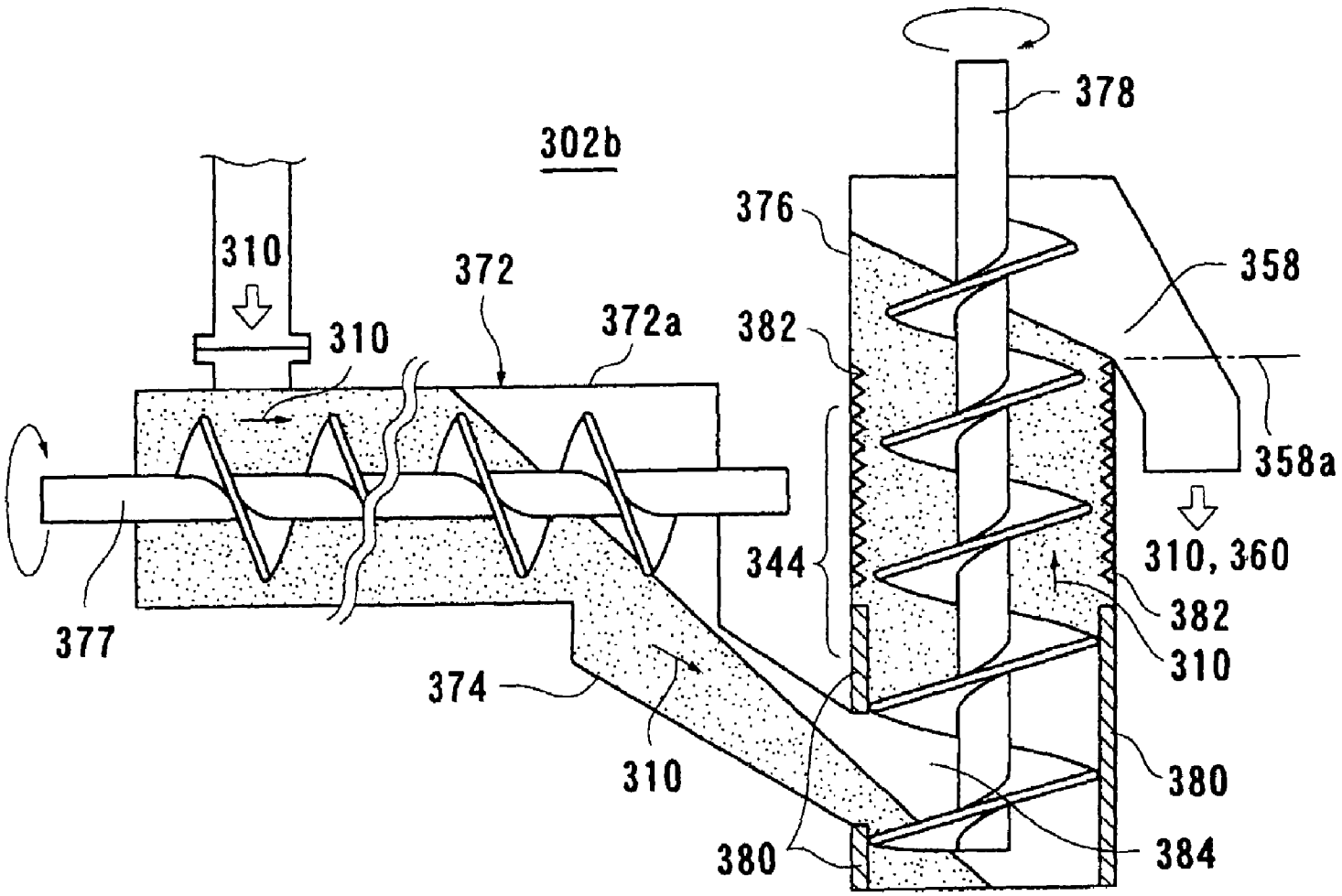
FIG. 10 is a schematic diagram showing an incombustible withdrawing system in a gasification system according to a ninth embodiment of the present invention.

FIG. 10 is a schematic diagram showing an incombustible withdrawing system 302*b* in a gasification system according to a ninth embodiment of the present invention. The incombustible withdrawing system 302*b* has a mixture delivery path 372 including a horizontal portion 372*a* for delivering a fluidized medium 310 substantially in a horizontal direction, a screw conveyor 377 rotatably supported in the horizontal direction within the horizontal portion 372*a* of the mixture delivery path 372, an inclined path 374 provided at a delivery end of the horizontal portion 372*a* of the mixture delivery path 372, a vertical path 376 as an incombustible discharge passage vertically extending from a lower end of the inclined path 374, a screw conveyor 378 rotatably supported as a fluidized medium delivering device, and an incombustible discharge port 358 for discharging a fluidized medium 310 and incombustibles 360 from an uppermost portion of the vertical path 376. The screw conveyor 378 is suspended from and cantilevered at a top of the vertical path 376.

The horizontal portion 372*a* of the mixture delivery path 372 serves to deliver the fluidized medium 310 toward the right side in FIG. 10 in the horizontal direction by rotation of a horizontal shaft of the screw conveyor 377. The mixture delivery path 372 serves to deliver the fluidized medium 310 to an upper portion of the inclined path 374, which is provided at a right end of the mixture delivery path 372. The fluidized medium 310 flows through the inclined path 374 to a bottom of the vertical path 376 due to its gravity.

The vertical path 376 serves to involve the fluidized medium 310 accumulated on the bottom of the vertical path 376 between a screw vane of the vertical screw conveyor 378 and an inner wall of the vertical path 376 by rotation of the screw conveyor 378 so as to deliver the fluidized medium 310 upward to an upper portion of the vertical path 376. The fluidized medium 310 delivered toward the top of the vertical path 376 by the vertical screw conveyor 378 is then discharged from the incombustible discharge port 358 to an exterior of the vertical path 376 due to its gravity together with the incombustibles 360. These discharged incombustibles 360 are recovered and can effectively be utilized outside of fluidized-bed furnace 350 (see FIG. 9).

For example, recovered incombustibles 360 can be used as sand for a road pavement material together with asphalt. Reusable silica sand is returned to the fluidized-bed furnace. Since the recovered incombustibles 360 contain substantially no unburned gas, no unburned gas is released to an atmosphere.

As shown in FIG. 10, a lowermost position 358*a* of the incombustible discharge port 358 is located at a height substantially equal to a height of the horizontal portion 372*a* of the mixture delivery path 372 as an incombustible discharge passage. If the fluidized medium 310 can be filled into rising portion 344 so as to seal purge gas 341 (see FIG. 9), then the lowermost position of the incombustible discharge port 358 may be located at position 358*a* as shown in FIG. 10. As long as the fluidized medium 310 can be filled into the rising portion 344 so as to seal the purge gas 341, the lowermost position of the incombustible discharge port 358 may be located at a position 358*a* as shown in FIG. 9, which is higher than a height of the surface 366 of circulating fluidized bed 312.

The vertical path 376 has a roughened inner surface 382 at an upper portion of the vertical path 376. The roughened inner surface 382 has a roughness higher than that of a lower inner surface. The vertical screw conveyor 378 has a screw vane designed so as to have a small horizontal cross-section in a range facing the roughened inner surface 382, and to thus have a large clearance between the screw vane and the roughened inner surface 382. For example, the clearance between the screw vane and the roughened inner surface 382 can be set to be at least three times a maximum particle diameter of the fluidized medium. With this arrangement, since the fluidized medium 310 and the incombustibles 360 are likely to flow down in the vertical path 376 due to its gravity, sealing effects can be enhanced.

On the other hand, the vertical path 376 has a smooth liner 380 at a lower portion of the vertical path 376. The liner 380 has a roughness lower than that of an upper inner surface. The vertical screw conveyor 378 has a screw vane designed so as to have a large horizontal cross-section in a range facing the liner 380 and to thus have a small clearance between the screw vane and the liner 380. For example, the clearance between the screw vane and the liner 380 is preferably set to be less than three times a maximum particle diameter of the fluidized medium.

Upper and lower inner surfaces of the rising portion 344 in the vertical path 376 are formed in a continuous manner. The upper inner surface of the rising portion 344 is designed so as to have a large clearance between the upper inner surface and the screw vane (e.g., at least three times a maximum particle diameter of the fluidized medium). The lower inner surface of the rising portion 344 is designed so as to have a small clearance between the lower inner surface and the screw vane (e.g. less than three times a maximum particle diameter of the fluidized medium).

Next, operation of the vertical path 376 will be described below. Since the clearance between the upper portion of the vertical path 376 and the screw vane facing the roughened inner surface 382 is large, the delivery efficiency of the fluidized medium 310 is low. On the other hand, since the clearance between the lower portion of the vertical path 376 and the screw vane facing the liner 380 is small, the delivery efficiency of the fluidized medium 310 is high.

A difference of the delivery efficiency in the vertical path 376 allows the fluidized medium 310 at the lower portion of the vertical path 376 to push the fluidized medium 310 at the upper portion of the vertical path 376 so as to discharge the fluidized medium 310 at the upper portion of the vertical path 376 to the incombustible discharge port 358 when a fluidized medium 310 is newly supplied to the lower portion of the vertical path 376.

When a fluidized medium 310 is not newly supplied to the lower portion of the vertical path 376, the fluidized medium 310 cannot be pushed toward the incombustible discharge port 358. However, since the fluidized medium 310 is accumulated or filled in the rising portion 344 continuously extending from the upper portion to the lower portion of the vertical path 376, an air gap 384 is formed below the rising portion 344 as shown in FIG. 10. The air gap 384 serves as a space to be filled with a purge gas, which is formed at the bottom of the vertical path 376 when the fluidized medium 310 is not sufficiently supplied from the inclined path 374.

A fluidized medium reservoir chamber (not shown) may be provided so as to positively form an air gap at a portion interconnecting the mixture delivery path 372 and the vertical path 376. The fluidized medium reservoir chamber may comprise a tank having a certain volume.

Since the fluidized medium 310 is accumulated or filled in the rising portion 344 of the vertical path 376, a purge gas introduced from the mixture delivery path 372 can be sealed to hold the purge gas in the air gap 384. Therefore, even if the vertical screw conveyor 378 is rotated at rotational speeds within a wide range, a sufficient amount of fluidized medium 310 can be accumulated or filled in the rising portion 344.

When the purge gas in the air gap 384 is involved in the fluidized medium 310 supplied from the inclined path 374 and moved upward to the upper portion of the vertical path 376, a discharge duct (see FIG. 9) may be provided at an upper portion of the vertical path 376 to discharge the purge gas.

When the liner 380 disposed at the lower inner surface of the vertical path 376 has a low roughness, and a clearance between the screw vane and the liner 380 is set to be small, a suspension-type vertical conveyor may be used so that a vertical screw conveyor 378 is suspended from an upper portion of the vertical path 376.

In this case, a drive motor (not shown) may be provided at a top of the vertical path 376, and the vertical screw conveyor 378 may rotatably be supported at an upper end of a vertical shaft by an upper bearing. A lower end of the vertical screw conveyor 378 may rotatably be supported by an inner surface of the vertical path 376. The vertical screw conveyor 378 can be rotated by the drive motor.

The above vertical screw conveyor 378 can eliminate a lower bearing for rotatably supporting the lower end of the vertical screw conveyor 378, which is located at the bottom of the vertical path 376. However, in order to enhance reliability, a lower bearing may be used to reduce transverse vibration of the vertical screw conveyor 378 which is caused by rotation of the vertical screw conveyor 378.

Thus, intervals of maintenance of the vertical path 376 become longer to improve an operating ratio of the incombustible withdrawing system 302*b*. In the present embodiment, since the liner 380 has a smooth surface and a wear resistance is provided instead of a lower bearing, it is possible to effectively reduce transverse vibration of the vertical screw conveyor 378.

Further, periods during which the air gap 384 is produced can be adjusted by adjusting delivery capability of the fluidized medium 310 between the mixture delivery path 372 and the vertical path 376. For example, when the horizontal screw conveyor and the vertical screw conveyor have the same capability of delivering the fluidized medium, a rotational speed of the horizontal screw conveyor 377 is set to be lower than a rotational speed of the vertical screw conveyor 378. Accordingly, delivery capability of the horizontal screw conveyor 377 can be lower than delivery capability of the vertical screw conveyor 378. In this case, a period during which air gap 384 is present at a portion interconnecting the vertical path 376 and the inclined path 374 becomes long, and sealing effects of the purge gas can be enhanced.

In the above example, rotational speeds of the horizontal and vertical screw conveyors 377 and 378 are adjusted. However, in order to set delivery capability of the horizontal screw conveyor 377 so as to be lower than delivery capability of the vertical screw conveyor 378, screw pitches of the horizontal screw conveyor 377 may be set to be wider than screw pitches of the vertical screw conveyor 378, or a screw diameter of the horizontal screw conveyor 377 may be set to be smaller than a screw diameter of the vertical screw conveyor 378. With these arrangements, the air gap 384 can serve as a buffer in an incombustible withdrawing path to prevent leakage of the purge gas and to maintain a pressure of the purge gas in the mixture delivery path 372.

In a horizontal screw conveyor, gravity acts on an object to be conveyed as forces acting in a predetermined direction perpendicular to a screw shaft. However, in a screw conveyor having a screw shaft inclined at a rising angle of at least 60° with respect to a horizontal plane, small forces act in a predetermined direction perpendicular to a screw shaft. Forces acting in a predetermined direction perpendicular to the screw shaft serve to prevent an object from being rotated together with the screw shaft, and are thus important for stable delivery. Accordingly, in order to maintain a delivery efficiency in a screw conveyor having a screw shaft inclined at a rising angle of at least 60° with respect to a horizontal plane, it is necessary to prevent an object from being rotated together with the screw shaft without gravity.

In order to prevent the object from being rotated in a circumferential direction against a rotating screw, it is possible to employ frictional forces between an inner surface of a stationary screw casing and the object. It is desirable that frictional forces act in a circumferential direction, rather than a delivery direction, i.e. an axial direction of the screw shaft. Specifically, it is desirable that irregularities extending continuously parallel to the screw shaft be provided on the inner surface of the screw casing.

Figure 11:
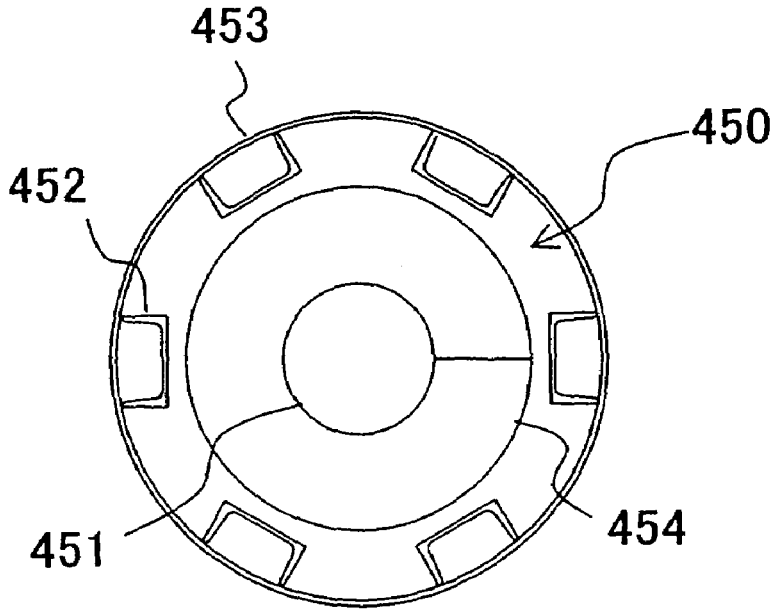
FIG. 11 is a schematic cross-sectional view showing a screw conveyor of an incombustible withdrawing system according to a tenth embodiment of the present invention.

FIG. 11 is a cross-sectional view showing a screw conveyor 450 according to the present invention. FIG. 11 shows a cross-section perpendicular to a screw shaft 451 of the screw conveyor 450. As shown in FIG. 11, the screw conveyor 450 has six projections 452 extending parallel to the screw shaft 451. The projections 452 project radially inwardly from an inner surface of a screw casing 453. In FIG. 11, the projections 452 comprise C-channels attached to the inner surface of the screw casing 453 by welding. Instead of the C-channels, L-shaped steels or flat bars may be used as the projections 452. With such an arrangement, an object is prevented from being rotated in a circumferential direction together with a rotating screw vane 454. Thus, stable delivery can be achieved.

However, depending on properties (size and shape) of incombustibles to be conveyed, with the arrangement shown in FIG. 11, the incombustibles may engage with the projections 452 or tip ends of the screw vane 454. In order to prevent such engagement of the incombustibles, it is necessary to properly select a clearance between the projections 452 and tip ends of the screw vane 454. In a case of municipal solid wastes, the clearance between the projections 452 and the tip ends of the screw vane 454 should preferably be at least 20 mm, and may be in a range of from 20 mm to 75 mm as needed.

Further, when a clearance between the inner surface of the screw casing 453 and the tip ends of the screw vane 454 is properly designed to be a small value without the projections 452 extending parallel to the screw shaft 451, the same effects can be obtained. Particularly, if sizes of incombustibles are smaller than cross-sectional areas of the projections 452, then the incombustibles accumulate in spaces between adjacent projections 452. As a result, there become substantially no spaces between the adjacent projections 452. In such a case, a clearance between the inner surface of the screw casing 453 and the tip ends of the screw vane 454 can simply be adjusted to a proper small value without the projections 452.

Although a proper clearance between the inner surface of the screw casing 453 and the tip ends of the screw vane 454 depends on properties (size and shape) of incombustibles to be conveyed, it should preferably be at most 75 mm, more preferably at most 50 mm, more preferably at most 25 mm in a case of municipal solid wastes. When the clearance is set to be smaller, incombustibles are more likely to engage between the screw vane 454 and the screw casing 453. Accordingly, the clearance should not be excessively reduced. In a case of municipal solid wastes, the clearance should preferably be at least 5 mm, more preferably at least 10 mm, more preferably at least 15 mm.

A screw conveyor having a screw shaft inclined at a rising angle of at least 60° with respect to a horizontal plane has originally been invented to fill an object to be conveyed in the screw conveyor and to prevent a gas from leaking out of a furnace. The inventors have confirmed the performance of screw conveyors having an inclined screw shaft as follows. As an inclination angle with respect to the horizontal plane becomes larger, spaces are more likely to be produced on a rear face of a screw vane, which conveys the object. Thus, a gas tends to leak through these spaces. Accordingly, in order to maintain a gas sealing performance, it is necessary to block the spaces (gas passages) produced on the rear face of the screw vane.

In order to block the spaces produced on the rear face of the screw vane, a rear vane, which is often used to strengthen vanes, can be used. Specifically, a reinforcing member may diagonally be provided continuously on a rear face of the screw vane by welding. Alternatively, ribs may be provided on a rear face of the screw vane substantially perpendicular to the screw vane and substantially perpendicular to the screw shaft.

As compared to a rear vane, ribs serve more advantageously to block gas passages formed on the rear face of the screw vane because the ribs are brought into contact with incombustibles in a state such that the ribs serve as scrapers to scrape the incombustibles. These scraped incombustibles serve to reliably fill the spaces produced on the rear face of the screw vane. Thus, ribs have greater advantages to block the gas passages as compared to a rear vane, which is brought into line contact with the incombustibles.

Further, the ribs are worn by contact with sand. Thus, ideal shapes of the ribs are eventually be formed automatically by abrasion. Once large ribs are provided, it is possible to maintain a sealing performance and form the ribs into ideal shapes.

However, when heights of the ribs are increased to enhance sealing performance and a degree of contact of the ribs with the sand is increased, rotation of the incombustibles together with the screw vane may be promoted, or a load may exceed an allowable power of a motor to thereby produce trip. Therefore, it is necessary to form the ribs into shapes as proper as possible.

The inventors have discovered that an optimum shape of a rib can be determined based on an inclination angle of a screw conveyor with respect to a horizontal plane and an angle of repose of a fluidized medium on a screw vane. Specifically, a basic shape of the rib is a right triangle arranged substantially perpendicular to the screw vane and the screw shaft to block gas passages formed by spaces on a rear surface of the screw vane. The right triangle has a side extending along a height of the screw vane from the screw shaft. It is desirable that an angle formed by the screw vane and the base of the triangle is $((90-A)+B)^\circ$, where A is an inclination angle (degree) of the screw conveyor with respect to the horizontal plane, and B is an angle (degree) of repose of a fluidized medium to be conveyed.

As a matter of course, the present invention is not limited to the above examples. A length of a side along the screw vane may be adjusted so as to be longer or shorter than the height of the screw vane in consideration of properties of an object to be conveyed. The rib may not be perpendicular to the screw vane or the screw shaft. The rib may be formed by a flat plate or a curved plate. In a case where the object to be conveyed mainly includes a fluidized medium discharged from a fluidized-bed combustion furnace or a fluidized-bed gasification furnace, it is desirable that the angle B of repose of the fluidized medium be in a range of from 30 to 45°, preferably in a range of from 30 to 40°, more preferably in a range of from 30 to 35°.

Figure 12:
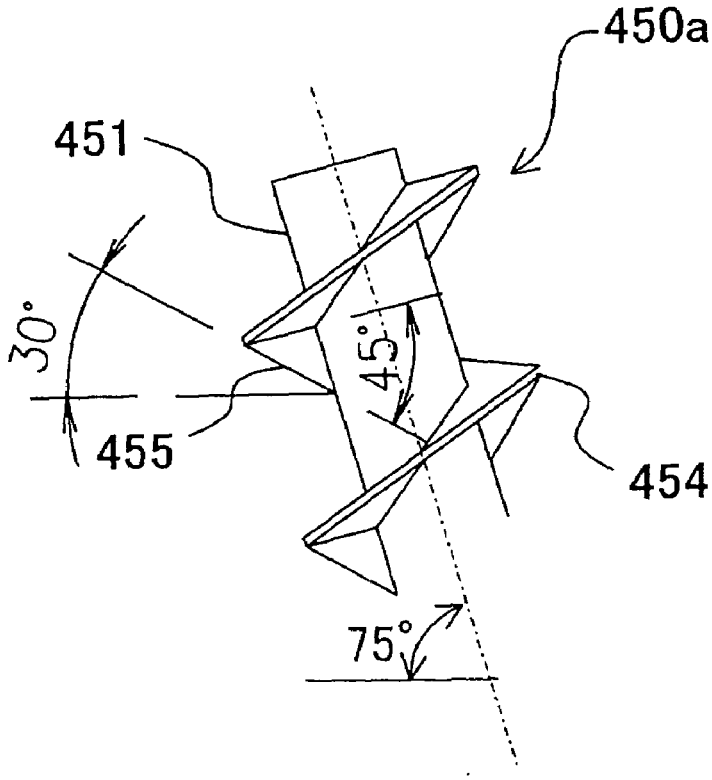
FIG. 12 is a front view showing a screw conveyor of an incombustible withdrawing system according to an eleventh embodiment of the present invention.

In an example shown in FIG. 12, a screw shaft 451 of screw conveyor 450*a* is inclined at 75° with respect to a horizontal plane, and an angle of repose of an object to be conveyed is 30°. Thus, each triangular rib 455 attached on a rear surface of a screw vane 454 has a base angle of 45° (=90°−75°+30°) with respect to the screw vane 454.

It is desirable that ribs 455 are not provided around the screw shaft 451 at pitches of 180° or 360°. If the ribs 455 are provided around the screw shaft 451 at pitches of 180° or 360°, then sealing effects of the ribs 455 are synchronized with the rotation of the screw shaft 451 so as to cause pulsation.

Figure 13:
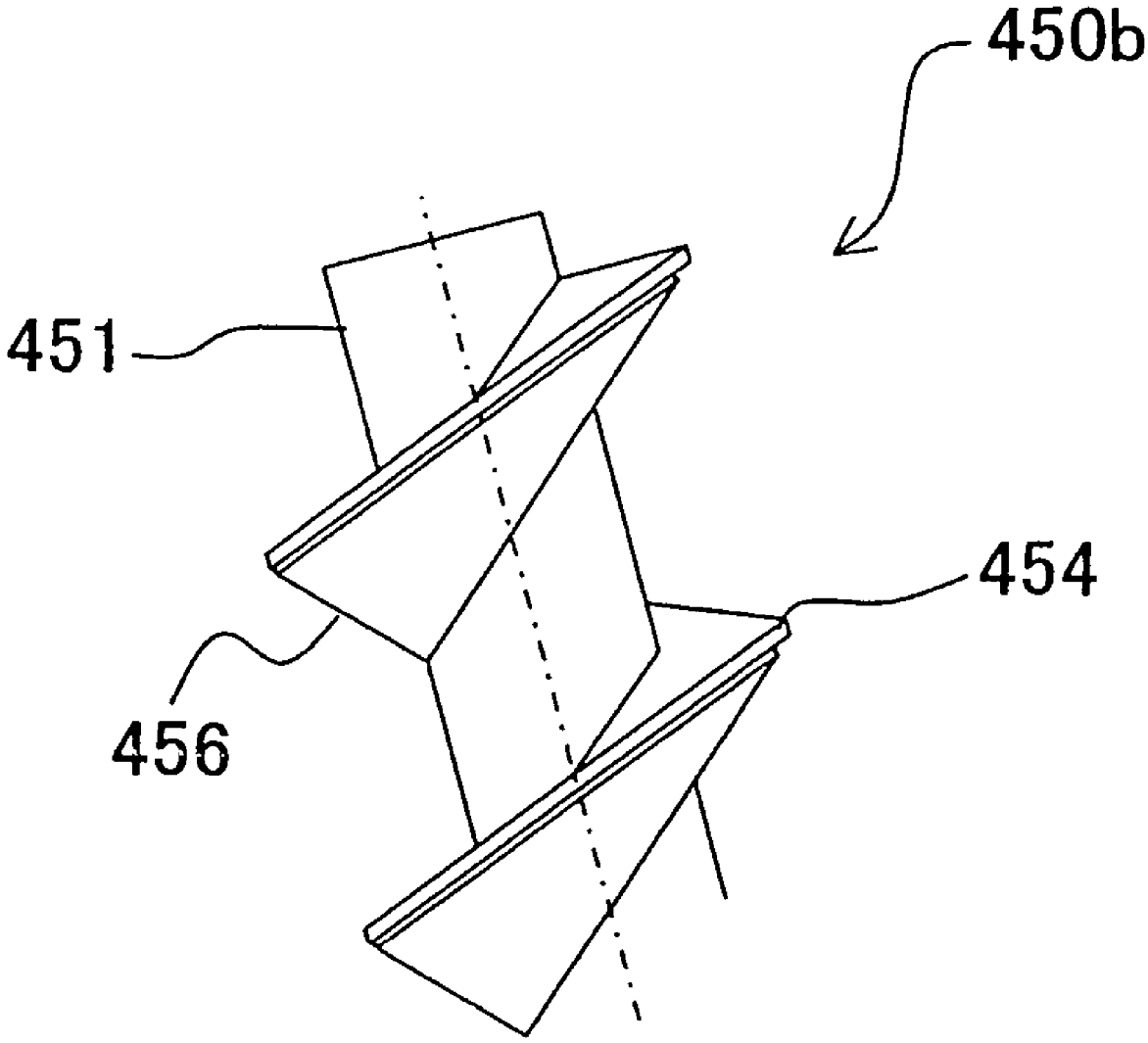
FIG. 13 is a front view showing a screw conveyor of an incombustible withdrawing system according to a twelfth embodiment of the present invention.

FIG. 13 is a front view showing a screw conveyor 450*b* according to another embodiment of the present invention. The screw conveyor 450*b* has a rear vane 456 provided continuously on a rear surface of a screw vane 454. The rear vane 456 has a base angle of 45° (=90°−75°+30°) with respect to the screw vane 454 as with the ribs 455 shown in FIG. 12.

The inventors have discovered parameters which can control an amount of delivery in a screw conveyor having a screw shaft inclined at a rising angle of at least 60° with respect to a horizontal plane, in addition to rotational speed of the screw shaft. Generally, a screw conveyor is designed so as to reduce abrasion of members which have speeds relative to an object higher than any other member, i.e. abrasion of tip ends of a screw vane. Accordingly, a maximum amount of delivery is automatically determined. Specifically, when a rotational speed of the screw shaft or a diameter of the screw vane is increased in order to enhance delivery capability, a speed of tip ends of the screw vane is also increased in proportion. Accordingly, it has been known that a screw conveyor has a limited amount of delivery.

According to experiments conducted by the inventors, delivery efficiency of a screw conveyor having a screw shaft inclined at a rising angle of at least 60° with respect to a horizontal plane is largely reduced to at most 30% of a horizontal screw conveyor. Thus, a screw conveyor having a screw shaft inclined at a rising angle of at least 60° has required a device to enhance delivery capability. The inventors have discovered that the delivery capability of the screw conveyor can be increased by increasing pressure of a lower portion of the screw conveyor, i.e. a portion disposed on an upstream side of a flow of an object.

As described above, in order to increase pressure of the lower portion of the screw conveyor, gas such as air may be blown into the screw conveyor. For example, in FIG. 3B, the fluidizing gas 331 may be blown into the fluidized medium separation chamber 390 disposed upstream of the screw conveyor 378. By adjusting an amount of the fluidizing gas 331, the pressure of the lower portion of the screw conveyor 378 can be adjusted. The fluidizing gas 331 may comprise an inert gas such as steam or nitrogen, carbon dioxide, oxygen, or a combination thereof. Since the pressure of the lower portion of the screw conveyor 378 varies in proportion to the amount of the fluidizing gas 331 to be blown, adjustment of the pressure can readily be performed.

According to an experiment using air as gas to be blown, the inventors have confirmed that delivery capability is increased two times more than a case using no gas to be blown. Experimental results show that it is possible to design a screw conveyor, which has a limited peripheral velocity of tip ends of a screw vane so as to prevent abrasion, in a considerably wide range.

Although certain preferred embodiments of the present invention have been shown and described in detail, it should be understood that various changes and modifications may be made therein without departing from the scope of the appended claims.

INDUSTRIAL APPLICABILITY

The present invention is suitable for use in an incombustible withdrawing system for withdrawing incombustibles together with a fluidized medium discharged from a fluidized-bed furnace for combusting, gasifying, or pyrolyzing wastes such as municipal wastes, refuse-derived fuel (RDF), waste plastics, waste fiber-reinforced plastics (waste FRP), biomass wastes, automobile shredder residue (ASR), and waste oil, or solid combustibles such as solid fuel containing incombustibles (e.g. coal).

The invention claimed is:

1. An incombustible withdrawing system for withdrawing an incombustible from a fluidized-bed furnace when a fluidized bed is formed therein by a fluidized medium, said withdrawing system comprising:

a mixture delivery path to deliver a mixture of the fluidized medium and the incombustible from a bottom of the fluidized-bed furnace, a fluidized-bed separating chamber disposed downstream of said mixture delivery path to fluidize the mixture by a fluidizing gas, and to separate the mixture into a first separated mixture having a high concentration of the fluidized medium and a second separated mixture having a high concentration of the incombustible;

a return passage to return the first separated mixture to the fluidized-bed furnace;

an incombustible discharge passage to discharge the second separated mixture to an exterior of the fluidized-bed furnace; and a fluidized medium delivering device within said incombustible discharge passage, such that said incombustible discharge passage is to discharge the second separated mixture to the exterior of the fluidized-bed furnace by having the second separated mixture be delivered non-vertically upwardly in said incombustible discharge passage by said fluidized medium delivering device, and then discharged from said incombustible discharge passage, at a position higher than a surface of the fluidized bed when formed in the fluidized-bed furnace, to the exterior of the fluidized-bed furnace.

2. The incombustible withdrawing system according to claim 1, wherein said incombustible discharge passage is disposed downstream of said fluidized-bed separating chamber.

3. The incombustible withdrawing system according to claim 1, wherein said return passage and said incombustible discharge passage are connected to said fluidized-bed separating chamber independently of each other, and said incombustible discharge passage is to discharge the second separated mixture to the exterior of the fluidized-bed furnace via an incombustible discharge port at the position higher than the surface of the fluidized bed when formed in the fluidized-bed furnace.

4. A fluidized-bed furnace system comprising:

a fluidized-bed furnace to have a fluidized bed formed therein by a fluidized medium so as to combust, gasify, or pyrolyze material containing an incombustible; and an incombustible withdrawing system including (i) a mixture delivery path to deliver a mixture of the fluidized medium and the incombustible from a bottom of said fluidized-bed furnace, (ii) a fluidized-bed separating chamber disposed downstream of said mixture delivery path to fluidize the mixture by a fluidizing gas, and to separate the mixture into a first separated mixture having a high concentration of the fluidized medium and a second separated mixture having a high concentration of the incombustible, (iii) a return passage to return the first separated mixture to said fluidized-bed furnace, (iv) an incombustible discharge passage to discharge the second separated mixture to an exterior of said fluidized-bed furnace, and (v) a fluidized medium delivering device within said incombustible discharge passage, such that said incombustible discharge passage is to discharge the second separated mixture to the exterior of the fluidized-bed furnace by having the second separated mixture be delivered non-vertically upwardly in said incombustible discharge passage by said fluidized medium delivering device, and then discharged from said incombustible discharge passage, at a position higher than a surface of the fluidized bed when formed in the fluidized-bed furnace, to the exterior of the fluidized-bed furnace.

5. The fluidized-bed furnace system according to claim 4, wherein said incombustible discharge passage is disposed downstream of said fluidized-bed separating chamber.

6. The fluidized-bed furnace system according to claim 4, wherein said return passage and said incombustible discharge passage are connected to said fluidized-bed separating chamber independently of each other, and said incombustible discharge passage is to discharge the second separated mixture to the exterior of the fluidized-bed furnace via an incombustible discharge port at the position higher than the surface of said fluidized bed when formed in the fluidized-bed furnace.

* * * * *